US007125340B1

(12) United States Patent
Priester et al.

(10) Patent No.: US 7,125,340 B1
(45) Date of Patent: Oct. 24, 2006

(54) MUSCLE TRAINING APPARATUS AND METHOD

(76) Inventors: William B. Priester, 14 Deepwood Dr., Jackson, TN (US) 38305; Richard E. May, 1201 11th Ave. South, Suite 400, Birmingham, AL (US) 35205

( * ) Notice: Subject to any disclaimer, the term of this patent is extended or adjusted under 35 U.S.C. 154(b) by 0 days.

(21) Appl. No.: 10/906,750

(22) Filed: Mar. 4, 2005

Related U.S. Application Data

(62) Division of application No. 10/681,971, filed on Oct. 9, 2003.

(51) Int. Cl.
*A63B 69/36* (2006.01)

(52) U.S. Cl. ..... 473/228; 473/223; 482/111

(58) Field of Classification Search ..... 473/223–228, 473/437, 451, 457; 482/109, 111; 446/217, 446/218, 233; 434/252
See application file for complete search history.

(56) References Cited

U.S. PATENT DOCUMENTS

| | | | | |
|---|---|---|---|---|
| 1,712,537 | A | 5/1929 | White | |
| 2,482,015 | A | 9/1949 | McConnell | |
| 2,804,306 | A | 8/1957 | Chedister et al. | |
| 2,910,297 | A * | 10/1959 | Bonetate | 473/228 |
| 3,565,444 | A | 2/1971 | La Rocca | |
| 3,758,117 | A | 9/1973 | Harrison | |
| 3,809,397 | A * | 5/1974 | Gruenewald | 473/457 |
| 3,829,102 | A | 8/1974 | Harrison | |
| 4,017,083 | A * | 4/1977 | Johnson | 473/231 |
| 4,379,552 | A | 4/1983 | Webb et al. | |
| 4,576,378 | A | 3/1986 | Backus | |
| 5,096,199 | A | 3/1992 | Wyatt, Jr. | |
| 5,100,148 | A | 3/1992 | Smith | |
| 5,143,376 | A | 9/1992 | Johnson | |
| 5,165,683 | A | 11/1992 | Beutler et al. | |
| 5,184,825 | A | 2/1993 | Ruth | |
| 5,209,482 | A | 5/1993 | Hopfer | |
| 5,236,192 | A | 8/1993 | Pitzel | |
| 5,338,035 | A | 8/1994 | Lyford | |
| 5,362,059 | A | 11/1994 | Grossman | |
| 5,395,107 | A * | 3/1995 | De Pippo | 473/451 |
| 5,456,650 | A | 10/1995 | Williams, Jr. et al. | |
| 5,571,048 | A | 11/1996 | Kenney | |
| 5,634,857 | A | 6/1997 | Bradshaw | |
| 5,971,828 | A * | 10/1999 | Lin | 446/217 |
| 5,971,864 | A | 10/1999 | Joshi et al. | |
| 5,984,684 | A * | 11/1999 | Brostedt et al. | 434/252 |
| 6,079,949 | A * | 6/2000 | Litvin | 416/246 |
| 2003/0207719 | A1 * | 11/2003 | Hughes | 473/228 |

* cited by examiner

*Primary Examiner*—Nini F. Legesse
(74) *Attorney, Agent, or Firm*—Luedeka, Neely & Graham

(57) ABSTRACT

The invention is directed to a method for exercising a weaker of two opposing muscle groups of a person moving an implement, such as a golf club, so that the two muscle groups apply forces in opposite directions to the implement to assist in maintaining the implement in an ideal motion path.

15 Claims, 17 Drawing Sheets

MUSCLE TRAINING APPARATUS AND METHOD

This application is a division of and claims priority to U.S. patent application Ser. No. 10/681,971 filed Oct. 9, 2003 titled Muscle Training Apparatus and Method.

FIELD

This invention relates to a muscle trainer and to methods of exercising a muscle. This invention particularly relates to a muscle trainer for use by an individual when exercising one or more muscles used to swing an implement, and/or when exercising one or more muscles used to rotate the implement, and to methods of exercising such muscles.

BACKGROUND OF THE INVENTION

Many types of activities require that an individual swing an implement in an attempt to successfully accomplish the end goal of participation in such activity. For example, when participating in any of several sporting games, an individual may be required to swing any of several different implements, each of which is unique to a particular one of the games. Examples of such implements include a bat in the games of baseball and softball, a racket used in the games of tennis and racket ball, and a club used in the game of golf. The swinging of an implement is also required in certain non-sports or work environments such as, for example, the swinging of a maul.

In any of the above-noted activities, an efficient and desired end result, achieved from the swinging of the implement, is accomplished when the implement is swung in an ideal path. The ideal path will vary depending on the individual's height, build, and flexibility. When an individual swings the implement in that individual's ideal path, various muscle groups must function together in a precise way. The need for muscular precision is particularly apparent in the game of golf, where the implement is a golf club and the individual is a golfer. If the individual is aligned properly and is swinging the implement at the proper speed along the ideal path, the end result will also be ideal.

In the game of golf, the golf club includes a metal or non-metal-composite shaft having a club head attached to one end of the shaft and a gripping material, referred to as "the grip," is attached to the shaft at the other end thereof. Another component of the game of golf is a golf ball. The general object of the game is for the golfer, by use of the club, to cause the ball to be moved typically from an earthen mound, referred to as "the tee," toward and into a small container, referred to as "the cup," which is located in a carpet of short grass, referred to as "the green," typically several hundred yards from the tee.

The golfer causes the ball to be moved generally by (1) grasping the grip of the club with both hands, (2) "addressing" the ball with the club head, which includes aligning "a sweet spot" of a front, or ball-impact, face of the club head with the ball, (3) raising the club, desirably through the ideal path, in a motion referred to as "the backswing", (4) locating the shaft of the club, upon completion of the backswing, in a transitional position behind the head of the golfer, (5) swinging the club forward from the transitional position, desirably returning through the ideal path, in a momentum-gathering motion referred to as "the downswing" and, desirably, (6) directing the sweet spot of the front face of the club head into impact-engagement with the ball to drive the ball along a desired trajectory and direction, leading to eventual placement of the ball in the cup.

The combined motions of the backswing and the downswing are referred to as "a stroke." Typically, several strokes by the golfer are required to advance the ball along a path, commonly referred to as "the fairway," between the tee and the green, and to its ultimate destination in the cup.

When the golfer addresses the ball with the ball-impacting front face of the club head (hereinafter referred to as the club face), the sweet spot of the club face is adjacent and aligned with the ball as noted above. As the golfer begins the backswing, the club head is moved, through an arc, away from the ball, but desirably maintains an initial arcing alignment between the club face and the ball. At some point during the initial segment of the backswing, there is anatomical/mechanical necessity for some degree of rotation of the club shaft such that the club face loses its arcing alignment with the ball. As the golfer swings the club through the downswing of the stroke, the golfer must effectively rotate the club in the reverse direction, preferably just before impact with the ball, to return the club face to arcing alignment with the ball.

Desirably, following movement of the club through the full stroke, the golfer should have returned the club face through the ideal path to the addressed position, with the momentum necessary to effectively strike and carry the ball in a desired trajectory and direction.

While it is a practical impossibility to accomplish a "perfect" golf swing each and every time a golfer swings the club to impact the ball, several professional golfers seem to accomplish a near "perfect" swing on a reasonably consistent basis. In attempts to bring some semblance of a near "perfect" swing to at least non-professional golfers, techniques have been developed to train the swinging muscles of a golfer, with a goal of developing muscle memory to provide a more consistent and efficient golf swing. Even so, there remains a need for a device and methods, which will better enable the golfer, or anyone swinging an implement, to swing the club or other implement along an ideal path.

SUMMARY

The above and other needs are met by a muscle trainer and methods which contemplate that when an individual swings an implement along a path, a first muscle or muscle group exerts a pulling force on the swinging implement in a first direction generally laterally of the ideal path. At the same time, a second muscle or muscle group exerts a pulling force on the swinging implement in a second direction generally laterally of the ideal path and generally in a direction which is opposite to the first direction. If the first and second muscles, or muscle groups, are of equal strength, the opposing pulling forces exerted upon the implement tend to maintain the implement in an ideal path to achieve the end result in an efficient and desirable manner.

As used hereinafter, the word "muscle" can mean a single muscle, a group of muscles, or both.

When swinging the implement, if the first muscle is stronger than the second muscle, the first muscle will dominate the weaker second muscle to the extent that the implement is pulled laterally away from the ideal path in the first direction, whereby the individual is not swinging the implement in the most efficient manner to accomplish the task at hand. This undesirable dominant-muscle condition, and its attendant disadvantages, is particularly apparent in sporting games such as, for example, the game of golf, where the implement is a golf club and the individual is a golfer.

One of the primary goals in golf involves achieving an ideal plane of the swing of the golf club. The ideal backswing plane has been described as being like a sheet of glass resting on the golfer's shoulders and extending to the golf ball, while the ideal downswing plane shifts to a flatter angle and is skewed for a more inside to outside club head path. To achieve these ideal planes, the path that the club shaft must follow during the swing must be an ideal one.

Hereinafter, the ideal club path and the ideal swing plane will both be referred to as the ideal club shaft plane. The ideal club shaft plane will be different for each golfer depending on the golfer's height, build, and flexibility.

An example of a common error in golf is to allow the club shaft to deviate behind or in front of the ideal club shaft plane. To achieve the result of keeping the club shaft within the ideal club shaft plane, two opposing groups of muscles in the golfer's hands and forearms, hereinafter referred to as the "front-of-the-plane" muscle group and the "behind-the-plane" muscle group, must function in a proper manner. One could consider the two muscle groups as being in a tug-of-war, pulling against each other to determine the actual club shaft plane. Ideally then, the two muscle groups should be of generally equal strength, such that neither group dominates the other group, and the shaft of the club is maintained within, and is not moved laterally from, the ideal club shaft plane.

To better represent the movement of the entire club in space, the position of the club face will hereinafter be referred to as the club face plane. Regardless of the loft of the club face, the club face plane represents the position of the club face as if the club face had zero degrees of loft. Unlike the ideal club shaft plane which has some degree of curvature, the club face plane is more appropriately defined as a true plane since it is an extension of the zero degree club face. The concept of the club face plane helps one to visualize the relationship between the movement of the club face and the club shaft during the swinging motion of the club.

The tug-of-war between the front-of-the plane muscle group and the behind-the-plane muscle group is further complicated by the anatomical/mechanical need for rotation of the shaft and club face plane during the swing. In a "two-plane-merger" golf swing theory, the two planes are the club shaft plane and the club face plane. With regard to the club shaft plane, it would be very difficult, if not impossible, for a human being to swing a golf club through a complete stroke while keeping the club shaft in one club shaft plane, in which said plane is a true plane. Hence, it is correct to state that the path in which the club shaft travels is not a true plane. The club shaft plane is a composite of an infinity of planes existing in a tangential relationship to the path of the club shaft.

At the address, or six o'clock, position, the club face plane is ideally a vertical plane which is essentially perpendicular to the club shaft plane. During the backswing of a right-handed golfer, viewed in a face-to-face perspective, the club face plane is rotated in a counter-clockwise direction about the axis of the club shaft to achieve a mechanically efficient movement in which the club face plane "slices" through the air in an aerodynamic fashion. Ideally, somewhere between the eight o'clock and ten o'clock backswing positions, the club face plane has been rotated ninety degrees in a counter-clockwise direction so that the club face plane merges, and is co-planar, with the club shaft plane. This ideal ninety degree rotation is referred to as the "merged" position. During the backswing completion position and the downswing, the club face plane should remain merged with the club shaft plane until just before impact when the club face plane is rotated ninety degrees in a clockwise direction to achieve a "square" impact position. This action defines the two-plane-merger golf-swing theory.

The rotation of the club shaft and the club face to effect the two-plane merger utilizes a rotary muscle system, which includes muscles from the front-of-the-plane muscle group and the behind-the-plane muscle group. When viewing a golfer's swing while standing in front of the golfer, the rotary muscle system can be divided into two muscle groups: the counter-clockwise rotary muscle group and the clockwise rotary muscle group.

In the two-plane-merger theory, over action of either group of rotary muscles will result in "demerged" errors. These demerged errors occur when the amount of club face plane rotation is either greater or less than ninety degrees. For example, during the backswing of a right-handed golfer, over action of the counter-clockwise rotary muscle group will result in an angle of rotation of the club face plane of greater than ninety degrees and an "open" club face position. Over action of the clockwise rotary muscle group will result in an angle of rotation of the club face plane of less than ninety degrees and a "shut" or "closed" club face position.

Other crucial variables associated with the swing include speed and arc. The arc refers to the path of the club head and is determined by the amount of extension of the hands away from the golfer's body, the timing of the golfer's wrist hinge, the amount of shoulder turn, and the amount of hip turn by the golfer. The arc and speed variables are much easier to manipulate and manage once the proper muscle memory for two-plane merger has been achieved.

The exercising and improvement of memory patterns of opposing muscle groups, such as, for example, the four muscle groups described above, can be accomplished by working opposing muscle groups through motions which are akin to the motions typically utilized when swinging a golf club in the normal fashion. If the dominant, or stronger, muscle group is exercised to the same extent as the dominated, or weaker, muscle group, any strength imbalance between the two muscle groups will be undesirably maintained. If the dominated muscle group is exercised solely in an effort to bring the strength level thereof in line with the dominating muscle group, then the dominating muscle would tend to lose muscle tone, and the desired memory patterns of the two muscle groups would be difficult, if not impossible, to attain.

Thus, there is a need for a muscle trainer, and methods of exercising, which will provide simultaneous sustained exercising of opposing muscle groups leading to the development of desired memory patterns, while, at the same time, processing the dominated muscle group through a more strenuous exercise program, to eventually provide balanced muscle strength of the opposing muscle groups.

The contemplated muscle trainer of this invention includes a body having a grip surface located thereon, and a force generator positioned at a prescribed location on the body, which is spaced from the grip surface, for urging the prescribed location of the body in a direction away from a force direction which the weaker muscle would normally apply to the implement in the swinging thereof by the person.

This invention further contemplates a muscle trainer including a body having a proximal end and a distal end spaced from the proximal end. A grip portion is formed on the body closer to the proximal end than to the distal end thereof. A force generator is located on the body, closer to the distal end than to the proximal end, and positioned for urging the distal end of the body in a direction away from the force direction which the weaker muscle would normally apply to the implement in the swinging thereof.

In addition, this invention contemplates a muscle trainer including a body having a proximal end and a distal end spaced from the proximal end. A grip portion is formed on the body closer to the proximal end than to the distal end thereof. A motor is located on the body, and a propeller is attached to the motor in such a position that, upon operation of the motor, the propeller is operated to urge the distal end of the body in the direction away from the force direction which the weaker muscle would normally apply to the swing muscle trainer in the swinging thereof.

Further, this invention contemplates a method of a golfer exercising at least a non-dominating plane muscle of two opposing plane muscles typically used by the golfer when attempting to swing a golf club in an ideal club shaft plane, where the non-dominating plane muscle applies a non-dominating swing force to the golf club in a non-dominating swing force direction, and a dominating plane muscle applies a dominating swing force in a dominating swing force direction to the golf club which is opposite the non-dominating swing force direction, and exceeds the non-dominating swing force.

The method contemplated by this invention includes the steps of swinging a golf club or a golf club simulator in a club shaft plane normally generated by the golfer, determining whether the actual club shaft plane is outside of an ideal club shaft plane due to the non-dominating plane muscle allowing the dominating plane muscle to pull the golf club in the dominating swing force direction away from the ideal club shaft plane, applying an external force to the golf-club simulator independently of any force applied by the golfer to further urge the simulator in the dominating swing force direction, and using the non-dominating plane muscle to pull the golf-club simulator against the external force in the non-dominating swing force direction toward the ideal club shaft plane, thereby exercising the non-dominating plane muscle in a more strenuous fashion than the dominating plane muscle to eventually provide balanced muscle strength of the two muscles.

Further, this invention contemplates a method of a golfer exercising at least a non-dominating rotary muscle of two opposing rotary muscles typically used by a golfer when attempting to swing a golf club with ideal two-plane-merger, where the non-dominating rotary muscle applies a non-dominating swing force to the golf club in a non-dominating swing force direction, and a dominating rotary muscle applies a dominating swing force in a dominating swing force direction to the golf club which is opposite the non-dominating swing force direction, and exceeds the non-dominating swing force.

The method contemplated by this invention includes the steps of swinging a golf club or a golf club simulator with the two-plane relationship normally generated by the golfer, determining whether the actual two-plane relationship is outside of the ideal two-plane merger relationship due to the non-dominating rotary muscle allowing the dominating rotary muscle to rotate the club face plane in the dominating rotary direction away from ideal two-plane merger, applying an external force to the golf-club simulator independently of any force applied by the golfer to further urge the simulator in the dominating rotary direction, and using the non-dominating rotary muscle to rotate the golf club simulator against the external force in the non-dominating rotary direction toward ideal two-plane merger, thereby exercising the non-dominating rotary muscle in a more strenuous fashion than the dominating rotary muscle to eventually provide balanced muscle strength of the two muscles.

Further, this invention contemplates a method of a golfer exercising the opposing plane muscles and the opposing rotary muscles in a simultaneous fashion.

In another aspect, the present invention provides a method of exercising two human-anatomy muscles which typically cooperate to perform a prescribed task. The method comprises the steps of exercising, at a prescribed level, one muscle of the two muscles, and simultaneously with the exercising of the one muscle, exercising another of the two muscles at a level greater than the prescribed level. In various alternative embodiments of the invention, the prescribed task is swinging a golf club, swinging a tennis racket or other similar type of racket, or swinging a baseball bat.

In yet another aspect, the invention provides a method of exercising two groups of human-anatomy muscles, where the two groups of muscles typically cooperate to perform a prescribed task. The method comprises the steps of exercising, at a prescribed level, one of the two groups of muscles, and simultaneously with the exercising one of the two groups of muscles, exercising another of the two groups of muscles at a level greater than the prescribed level. In various alternative embodiments of the invention, the prescribed task is swinging a golf club, swinging a tennis racket or other similar type of racket, or swinging a baseball bat.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

Figure 1:
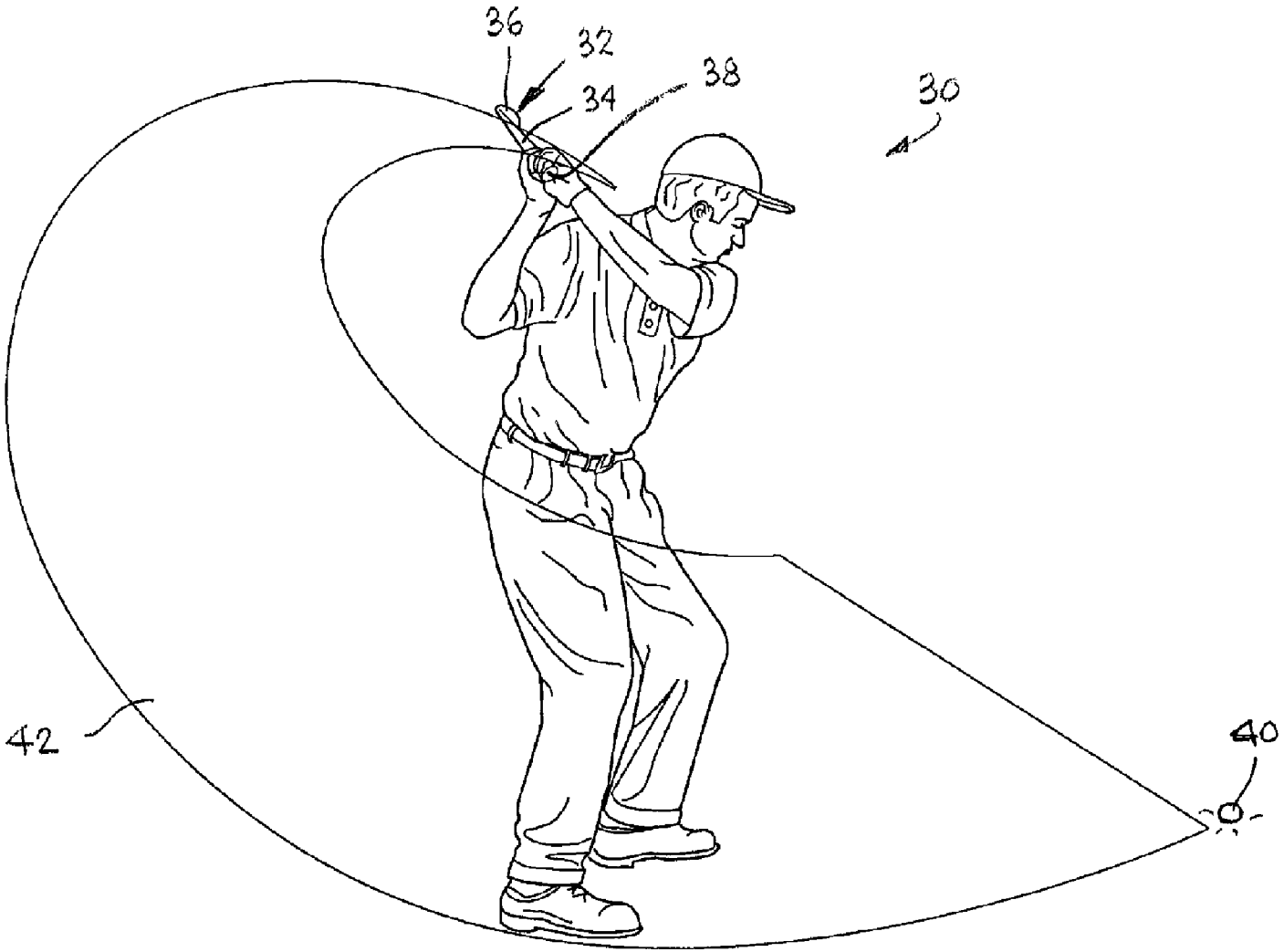
FIG. 1 is a perspective view showing a golfer having moved a golf club fully through a backswing to a backswing-completion position (hereinafter referred to as the twelve o'clock position) and through a generally "C" shaped path, the plane of which is referred to as a club shaft plane, representing the ideal plane of travel of a shaft of the golf club during the backswing thereof.
Figure 4:
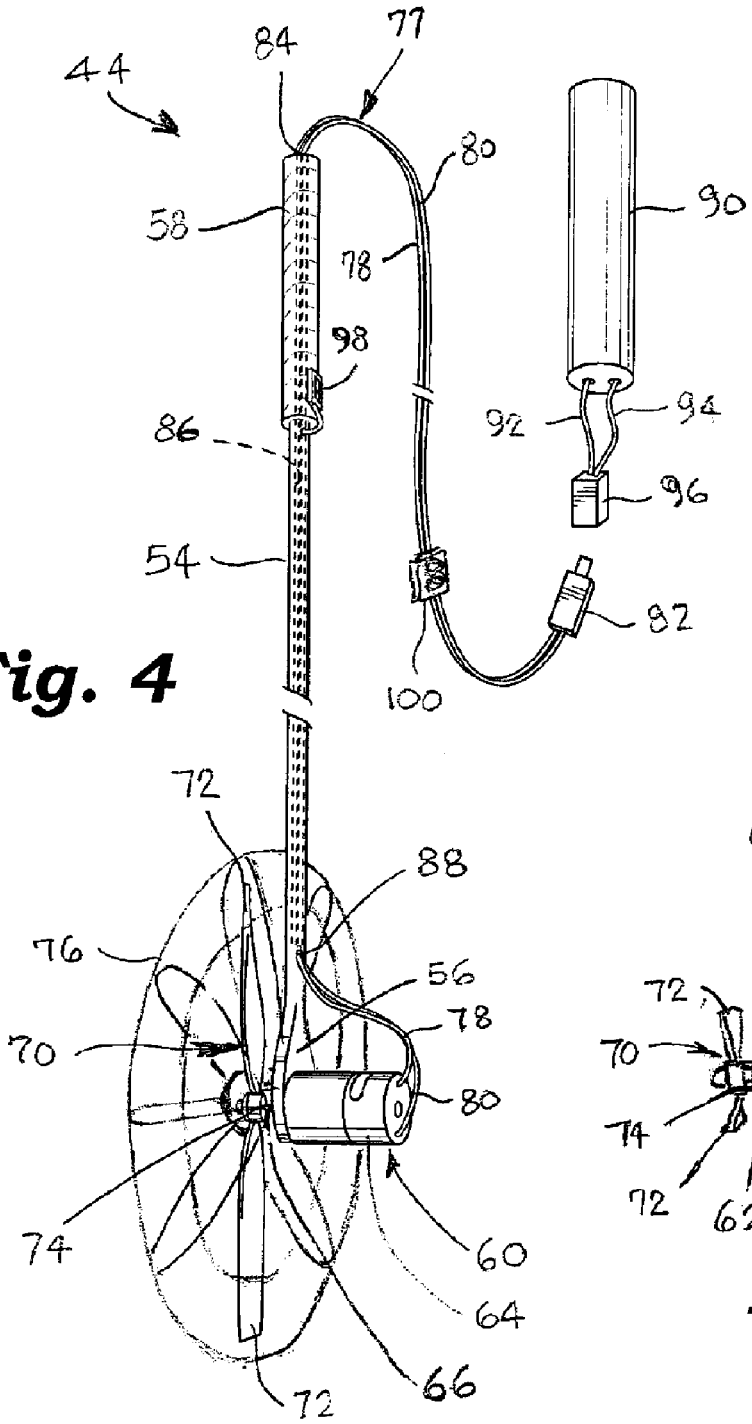
FIG. 4 is a perspective view showing a first embodiment of a muscle trainer in accordance with a preferred embodiment of the invention.
Figure 5:
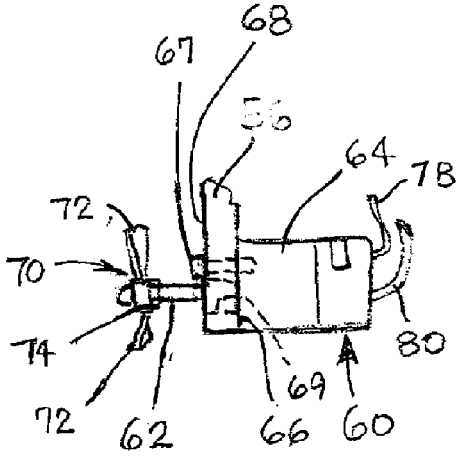
FIG. 5 is a partial side view showing a motor and fan blade assembly of the muscle trainer of FIG. 4 in accordance with a preferred embodiment of the invention.
Figure 7:
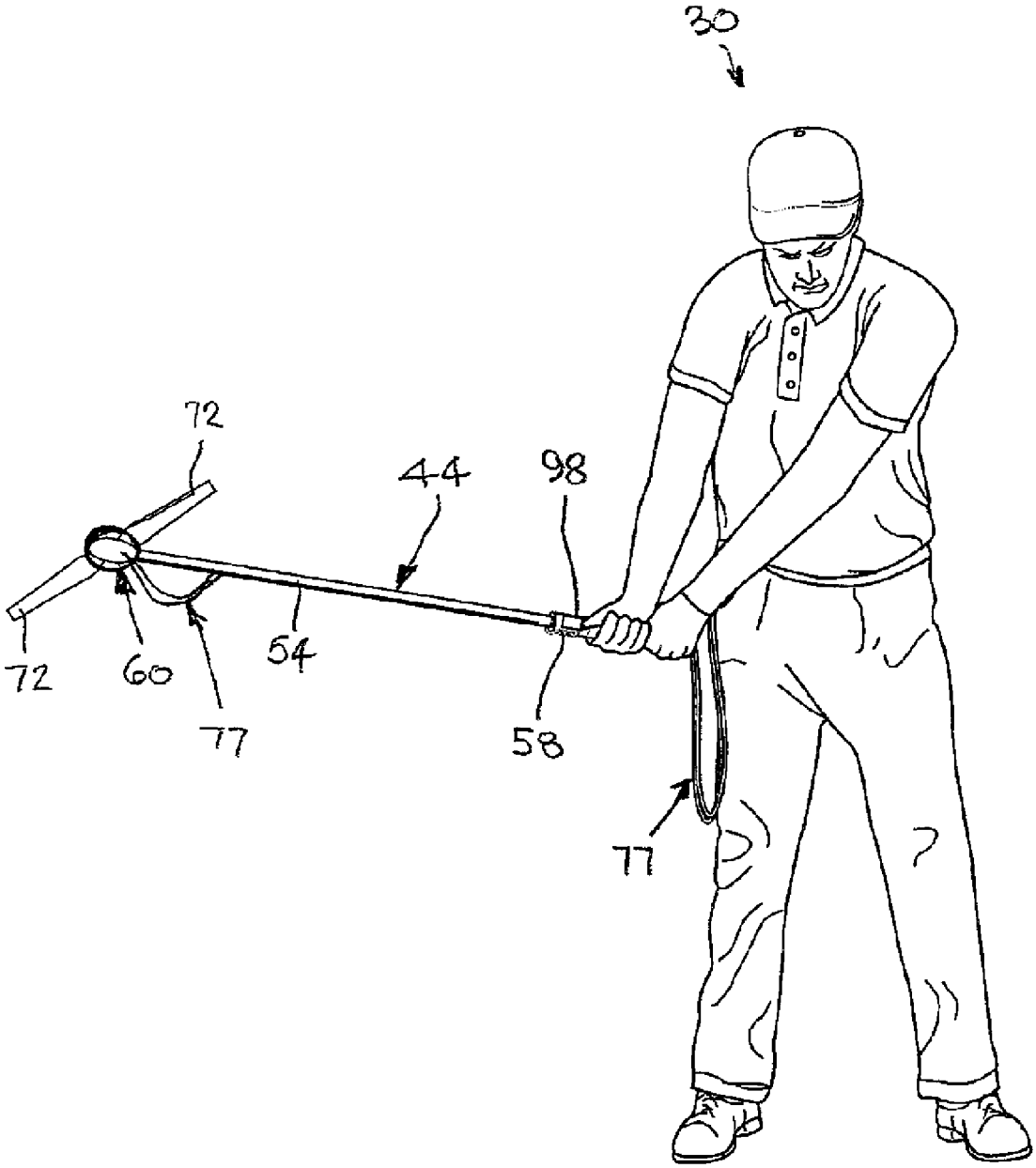
FIG. 7 is a front perspective view showing the golfer of FIG. 1 in a nine o'clock position, relative to the six o'clock position of FIG. 6, while gripping the muscle trainer of FIG.
Figure 8:
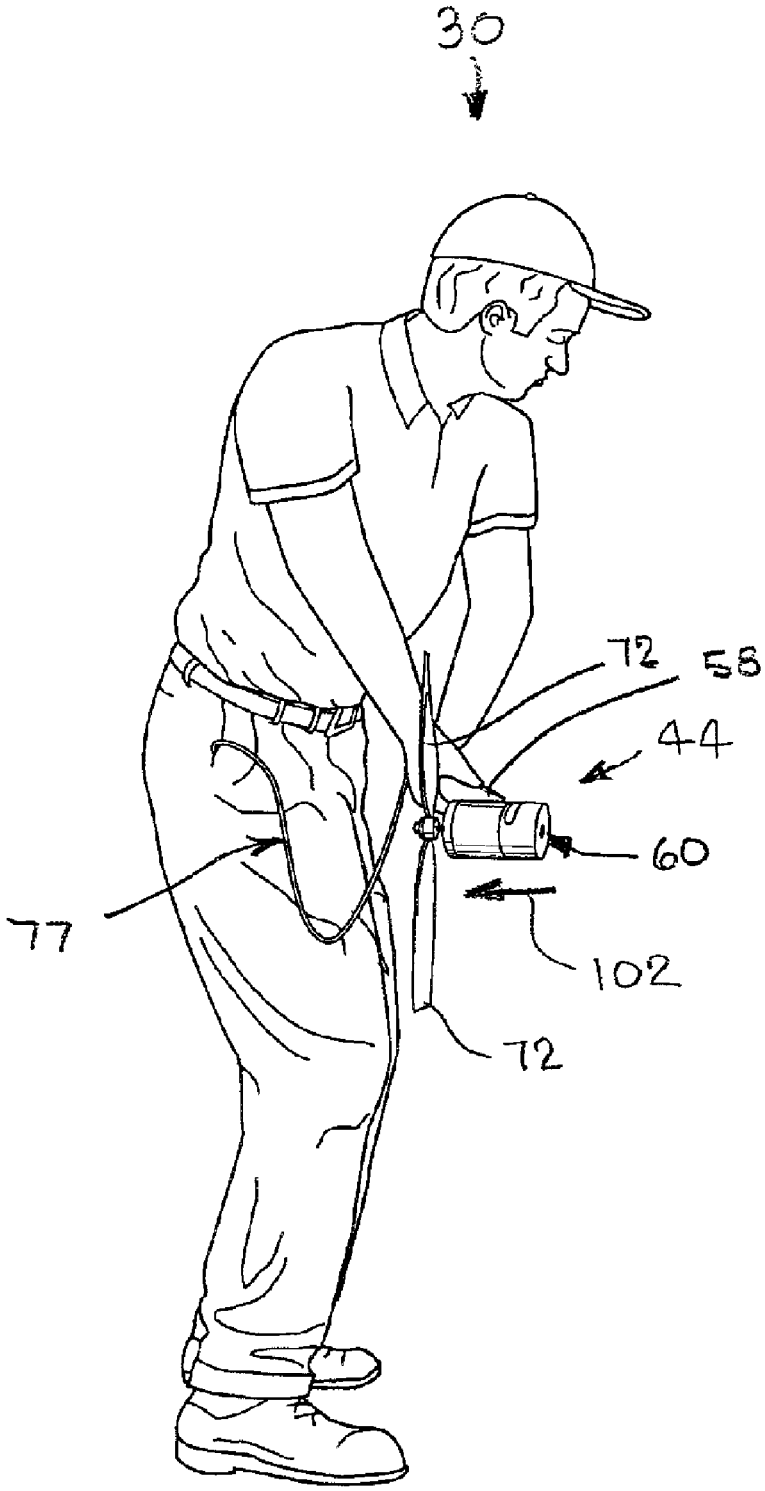
Figure 9:
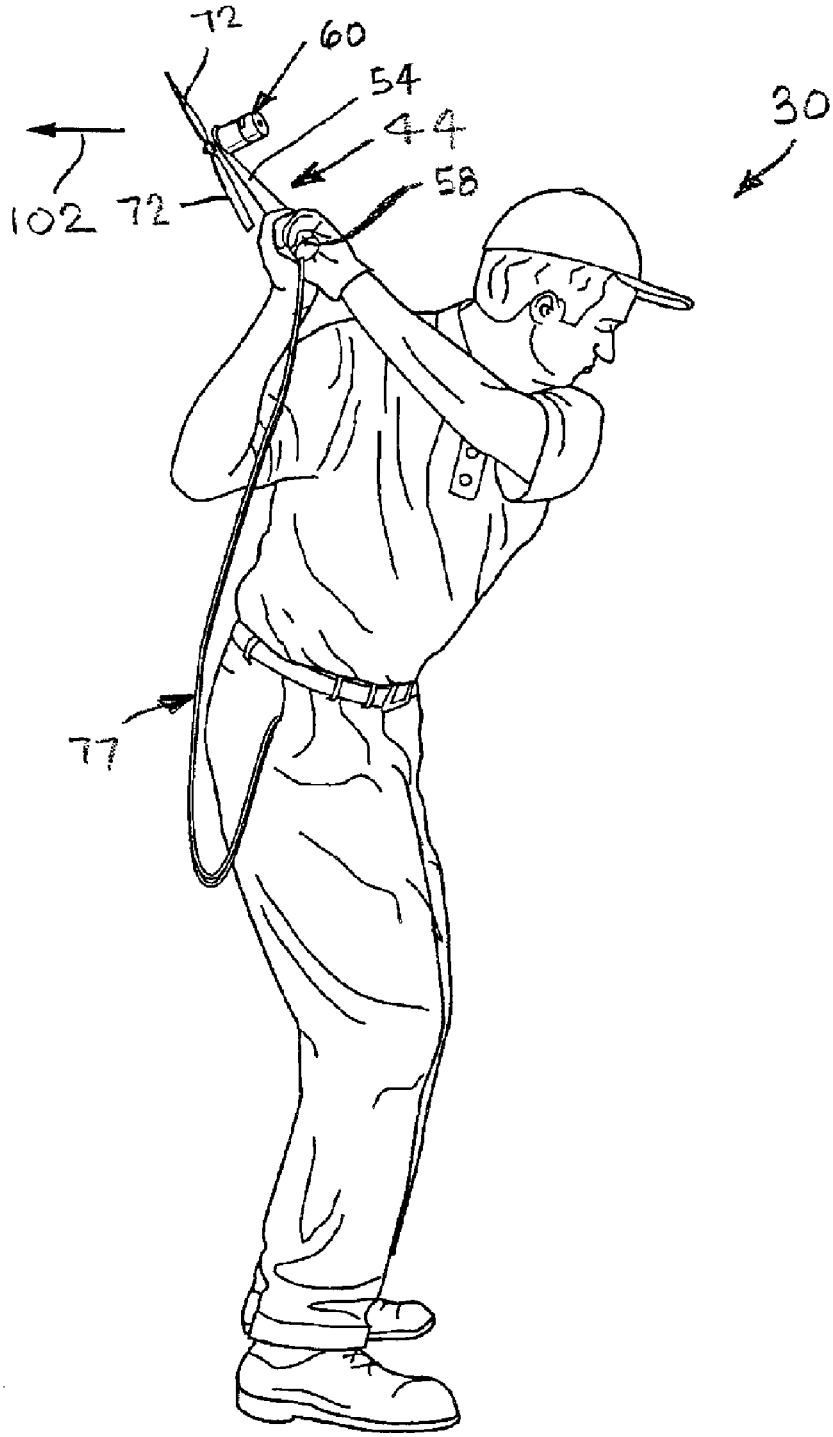
Figure 11:
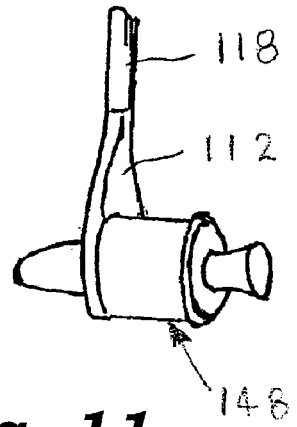
Figure 10:
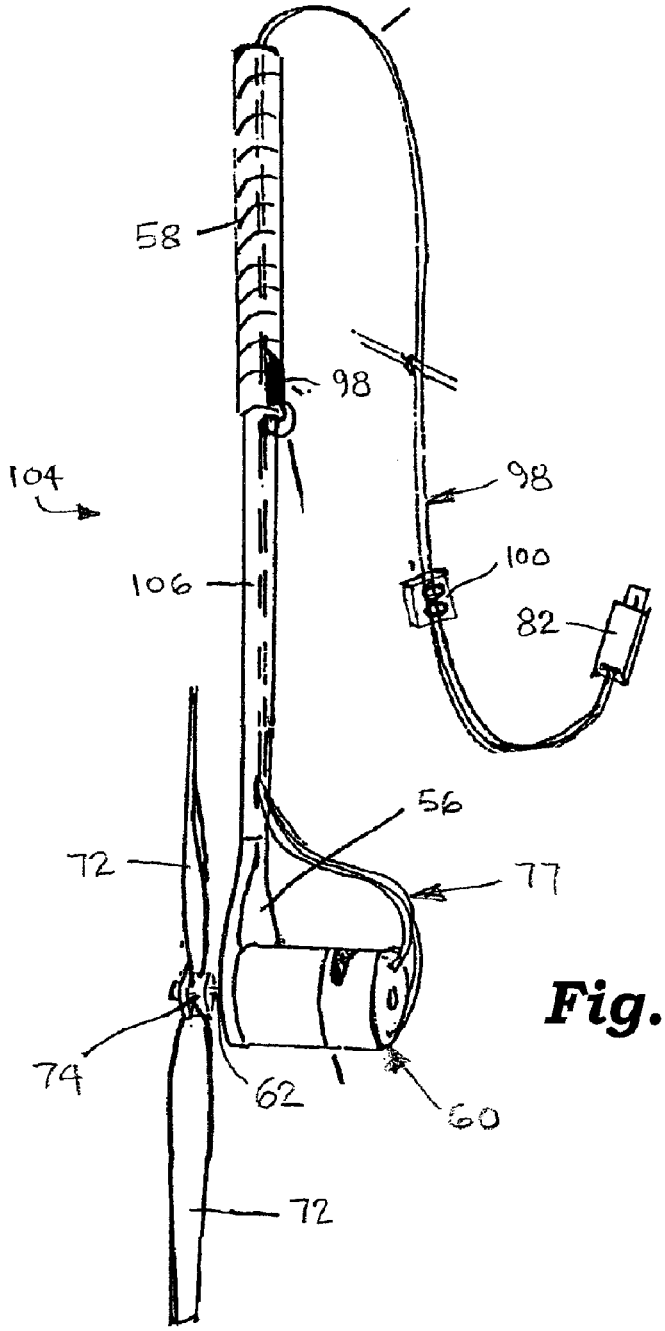
Figure 12:
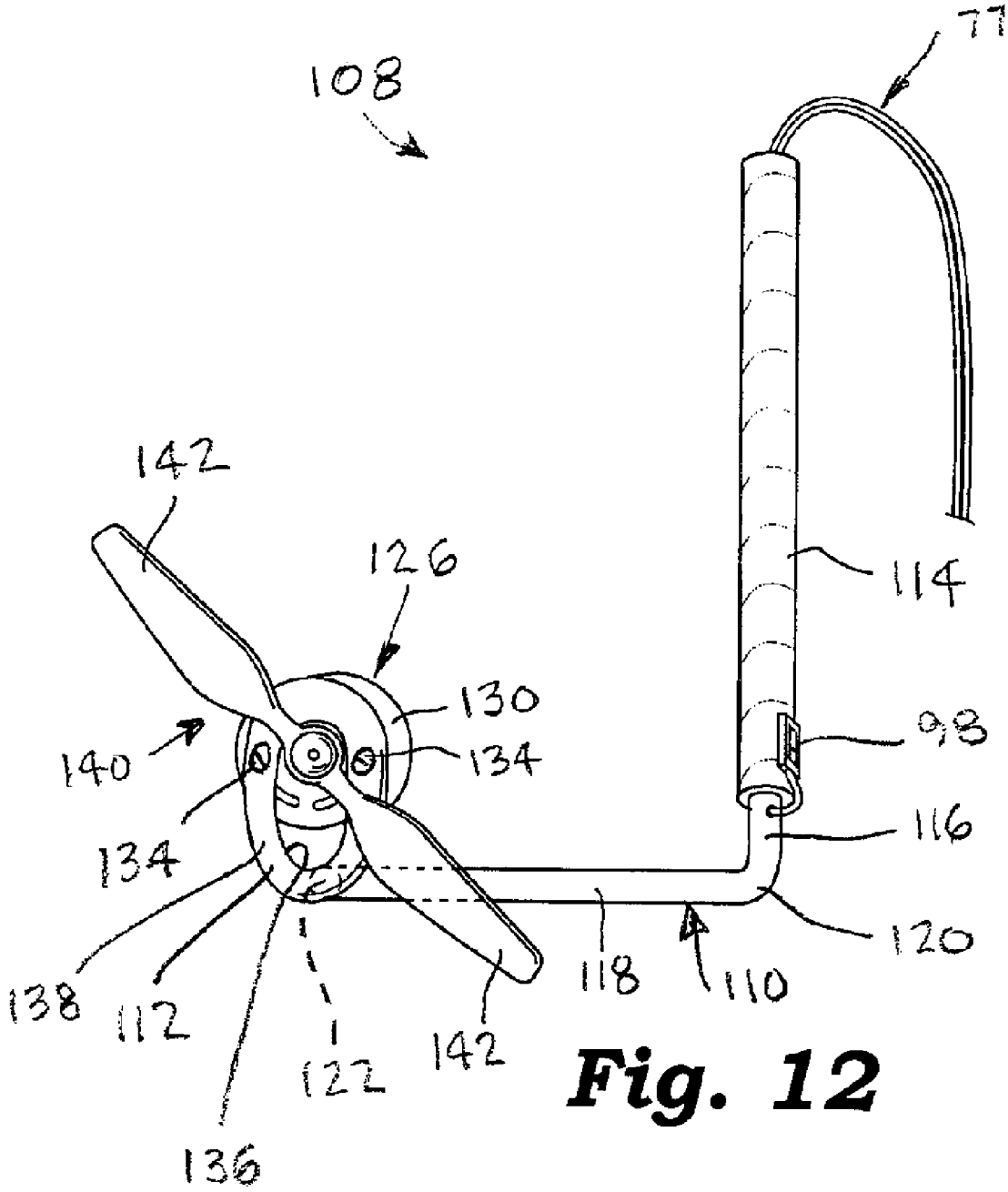
Figure 13:
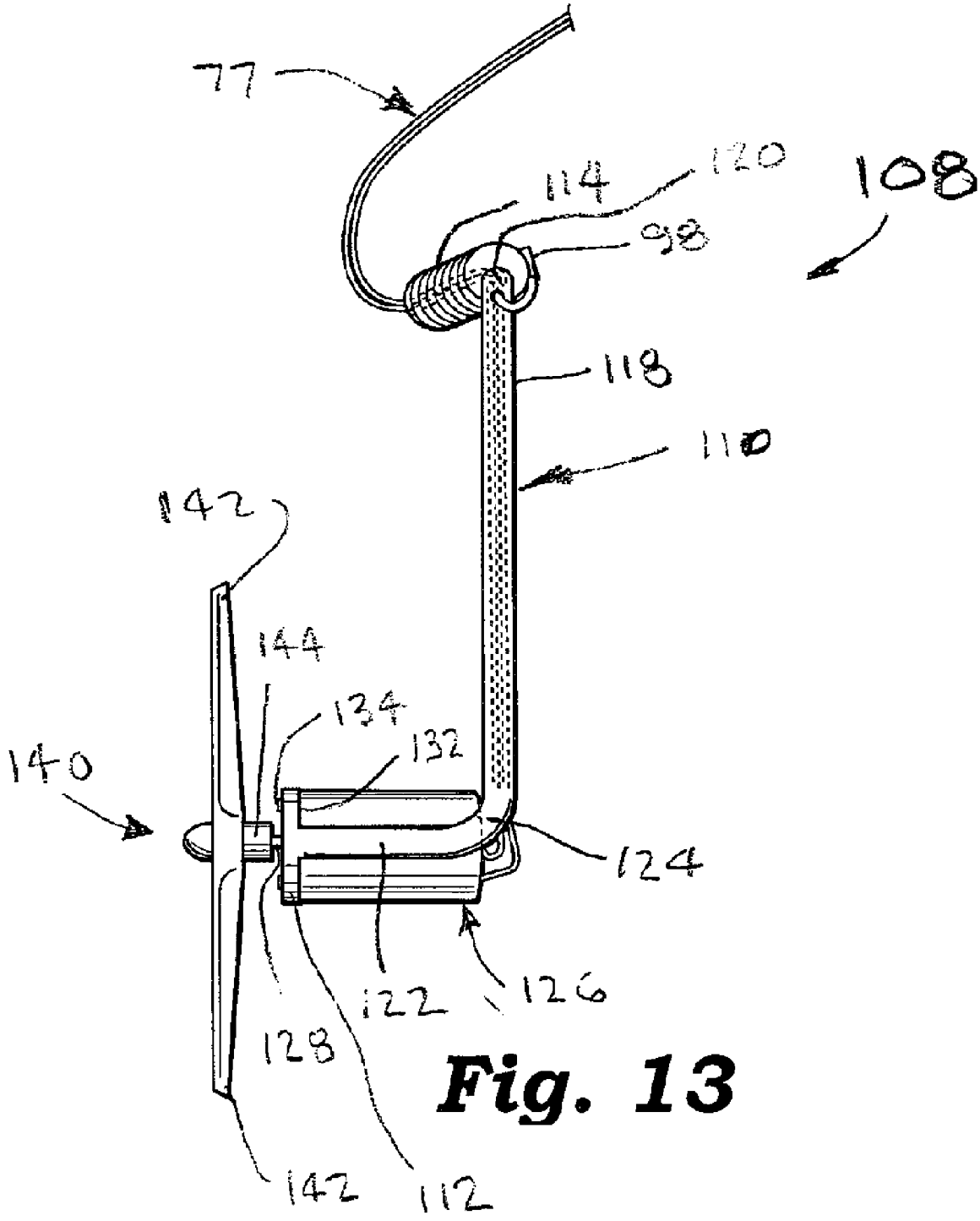
Figure 14:
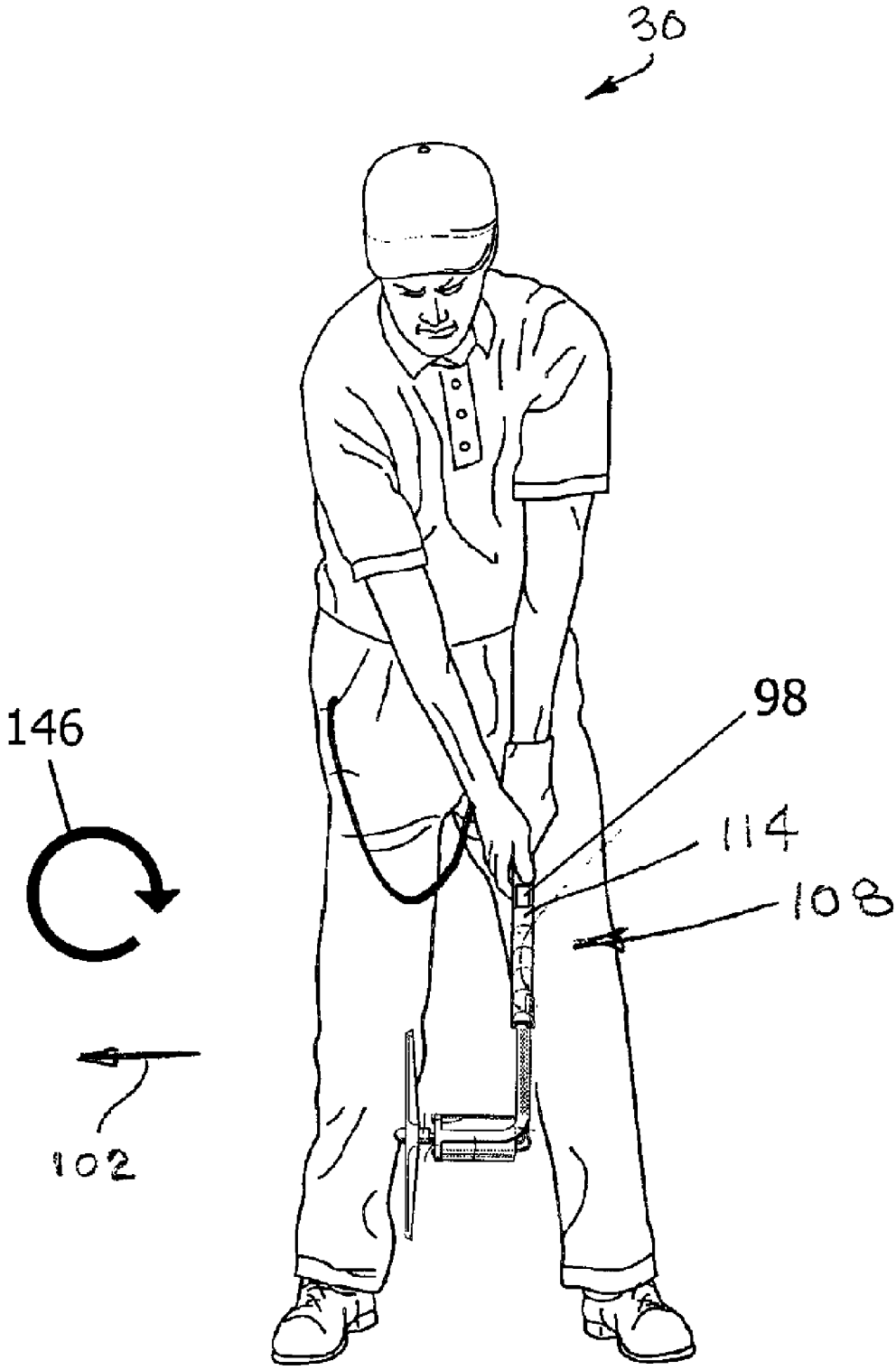
Figure 15:
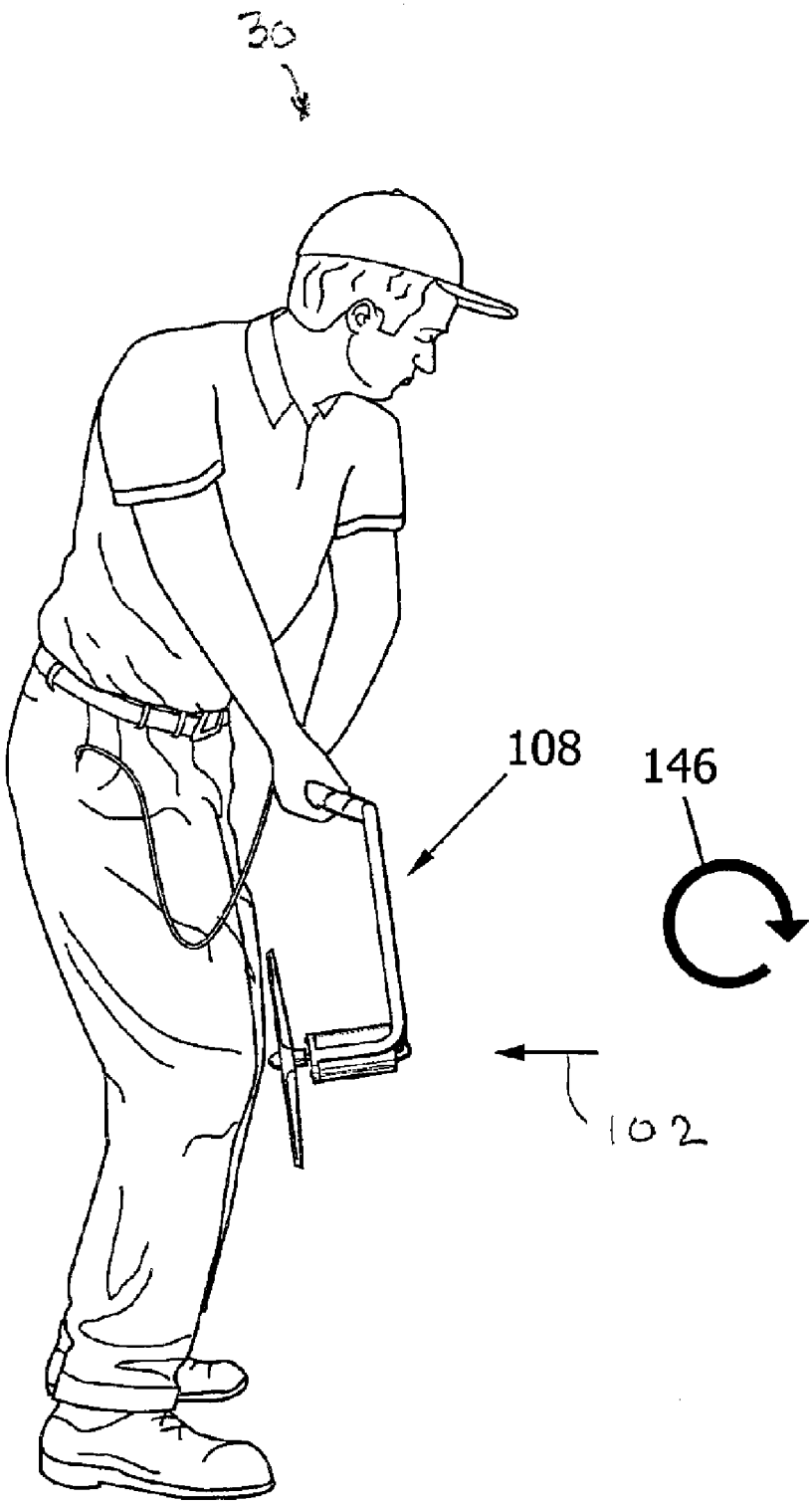
Figure 16:
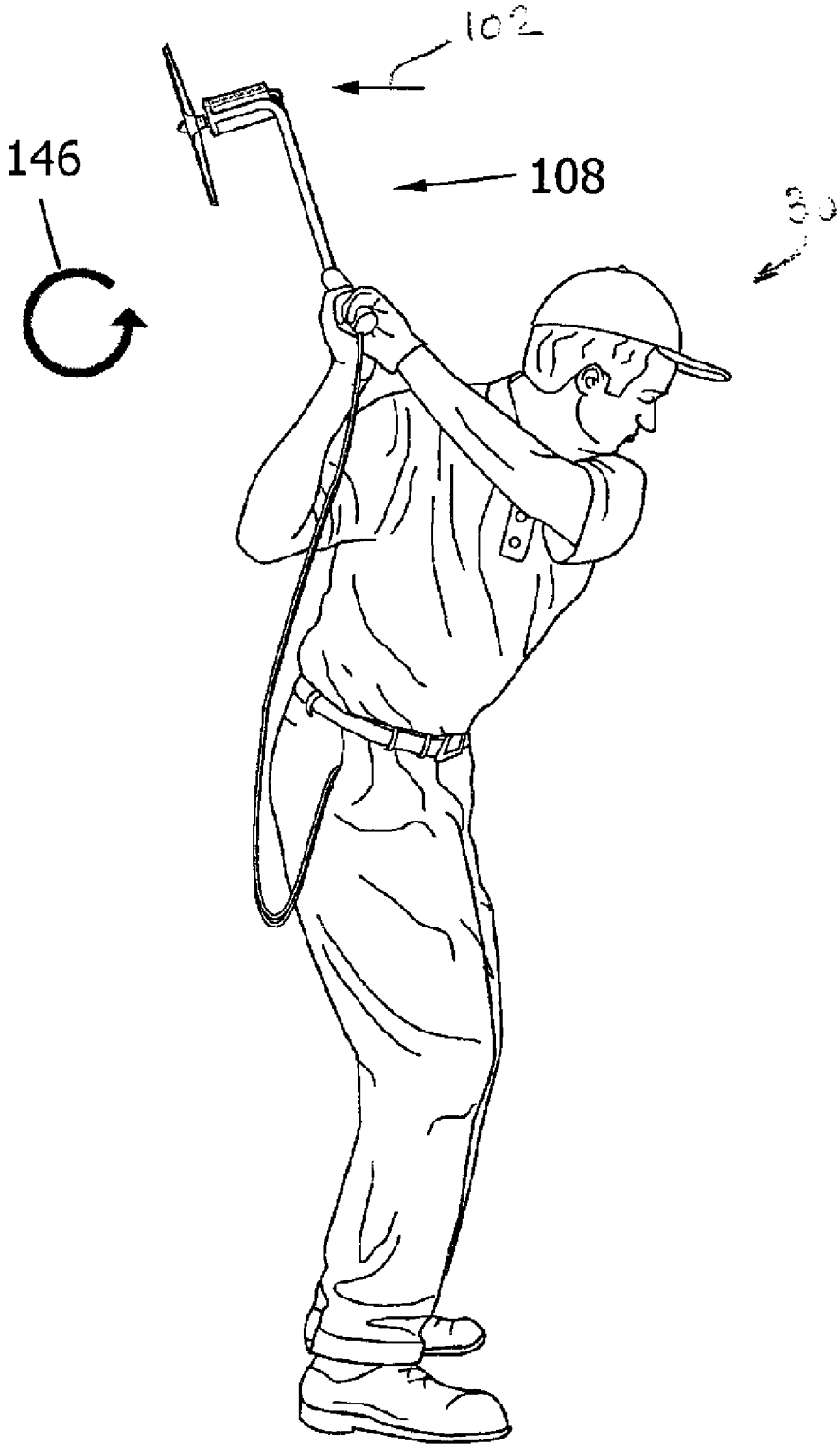
Figure 18:
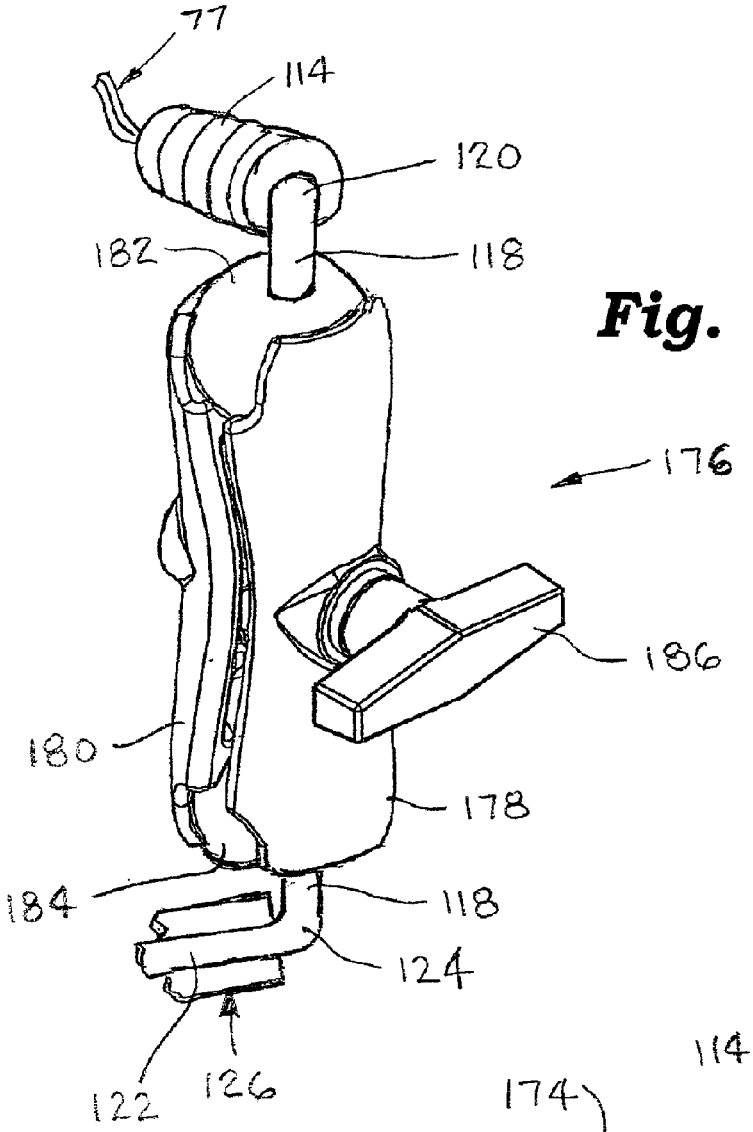
Figure 17:
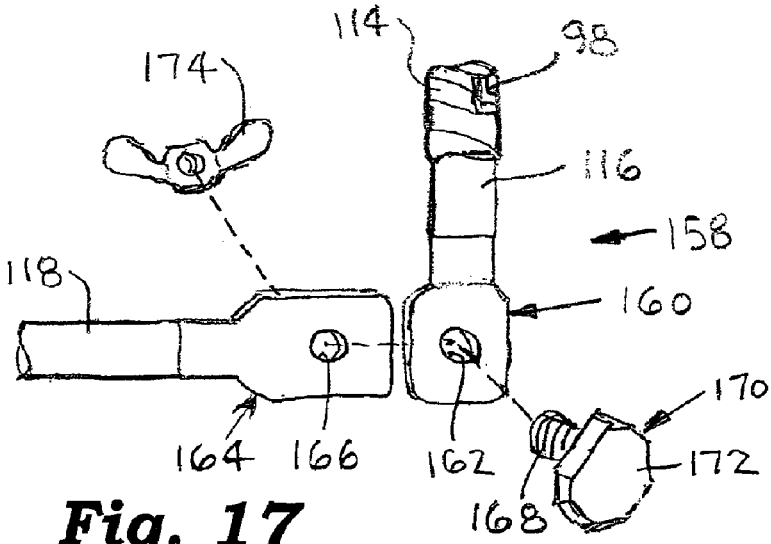
Figure 19:
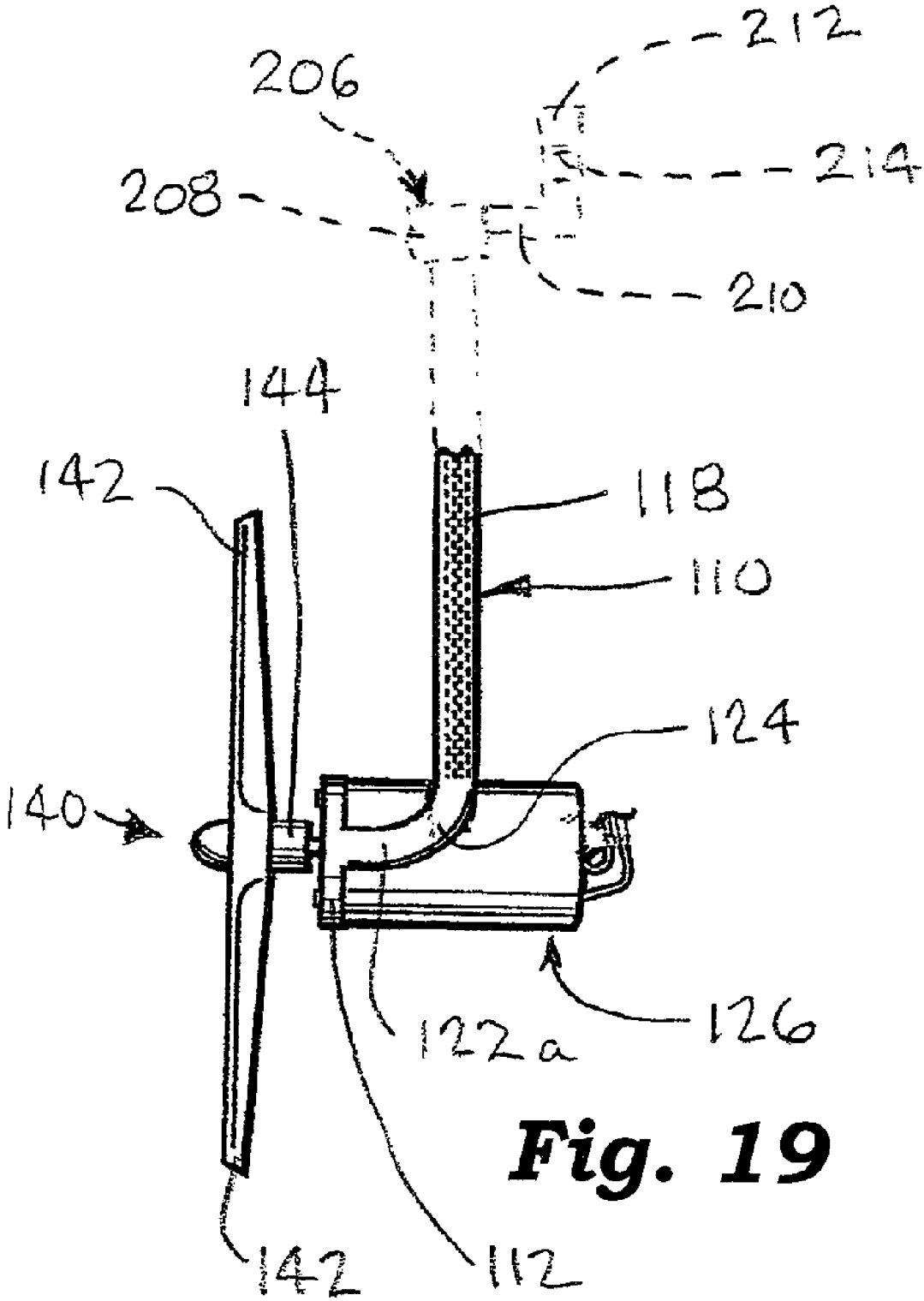
Figure 20:
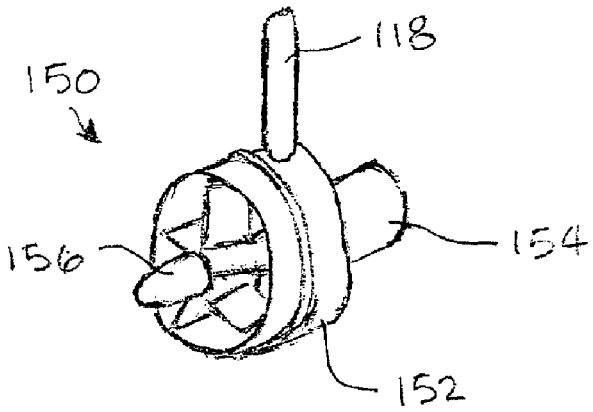
Figure 21:
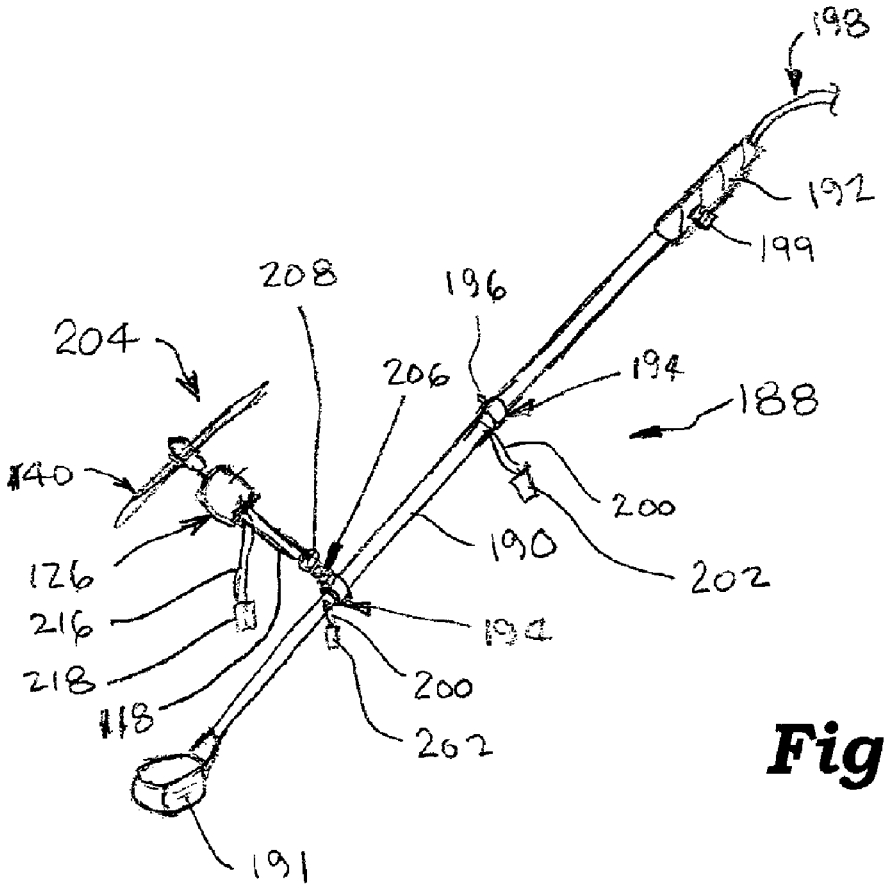

4 in the process of a muscle training exercise, in accordance with a preferred embodiment of the invention;

FIG. 8 is a side perspective view showing the right side of the golfer of FIG. 1 in the nine o'clock position of FIG. 7 while gripping the muscle trainer of FIG. 4 in the process of a muscle training exercise, in accordance with a preferred embodiment of the invention;

FIG. 9 is a side perspective view showing the right side of the golfer of FIG. 1 in the backswing-completion position of FIG. 1 while gripping the muscle trainer of FIG. 4 in the process of a muscle training exercise, in accordance with a preferred embodiment of the invention;

FIG. 10 is a perspective view showing a muscle trainer in accordance with an alternative embodiment of the invention;

FIG. 11 is a partial perspective view showing a motor which can be used in place of the motor of FIG. 5, in accordance with a preferred embodiment of the invention;

FIG. 12 is a front perspective view showing a muscle trainer in accordance with an alternative embodiment of the invention;

FIG. 13 is a bottom perspective view showing the muscle trainer of FIG. 12;

FIG. 14 is a front perspective view showing the golfer of FIG. 1 gripping the embodiment of the muscle trainer of FIG. 12, with the muscle trainer in a six o'clock position in preparation for a muscle training exercise;

FIG. 15 is a side perspective view showing the golfer of FIG. 1 in a nine o'clock position, relative to the six o'clock position of FIG. 14, while gripping the muscle trainer of FIG. 12 in the process of a muscle training exercise;

FIG. 16 is a side perspective view showing the right side of the golfer of FIG. 1 in the backswing-completion position of FIG. 1 while gripping the muscle trainer of FIG. 12 in the process of a muscle training exercise;

FIG. 17 is a partial view showing a first facility for adjusting the relative position of a pulling force means with respect to the shaft of a preferred embodiment of the invention;

FIG. 18 is a partial perspective view showing a second facility for adjusting the relative position of the pulling force means with respect to the shaft of a preferred embodiment of the invention;

FIG. 19 is a partial side view showing a first modified version of the muscle trainer of FIG. 13 in accordance with a preferred embodiment of the invention;

FIG. 20 is a partial side view showing a second modified version of the muscle trainer of FIG. 13 in accordance with a preferred embodiment of the invention; and FIG. 21 is a side view of a conventional golf club, referred to as a driver, which has been modified to be used as a muscle trainer, in accordance with an alternative embodiment of the invention.

DETAILED DESCRIPTION OF PREFERRED EMBODIMENTS OF THE INVENTION

Referring to FIG. 1, a golfer 30 has completed a backswing of a golf club 32, with the club being at the peak of the backswing, or backswing-completion position, and poised for the beginning of a downswing of the club, in anticipation of the completion of a full stroke. The club 32 includes a club shaft 34 extending between a distal end and a proximal end thereof. A club head 36 is mounted on the distal end of the shaft 34, and a grip 38 is formed about a portion of the shaft at or near the proximal end of the shaft.

The grip 38 typically extends from an outboard end thereof, at the proximal end of the shaft 34, towards the distal end of the shaft, and terminates at an inboard end of the grip along an intermediate portion of the shaft. In preparation for swinging the club 32, the golfer 30 positions the golfer's hands on the grip 38 in a conventional club-gripping manner, whereby the thumb of one hand, for example, the right hand, is closer to the inboard end of the grip 38 than the thumb of the other hand. For description purposes, the thumb which is closer to the inboard end of the grip 38 is referred to herein as the inboard thumb.

Prior to initiating the backswing, the golfer 30 has placed the golfer's hands around the grip 38 in the conventional golf-gripping manner, and has "addressed" a golf ball 40, which is located in front of the golfer at an address, or six o'clock, position (FIG. 6), ideally to align a "sweet spot" of the club head 36 with the ball.

During the backswing movement of the club 32 from the six o'clock position to the backswing-completion position illustrated in FIG. 1, the golfer 30 moves the club shaft 34 through a generally "C" shaped path 42, referred to hereinafter as "the club shaft plane." The ideal club shaft plane flattens and skews slightly during the downswing to create a separate and distinct ideal downswing club shaft plane. The golfer's ability to generate an ideal downswing club shaft plane is almost entirely dependent on the golfers ability to maintain an ideal backswing club shaft plane. By maintaining the club within these ideal club shaft planes, the golfer is more likely to strike the golf ball with the "sweet spot" of the club face to attain the desired trajectory and direction of the ball.

While professional golfers occasionally make errant shots, such shots are infrequent. With their inherent ability, training regimen, muscle balance and muscle memory patterns, the professionals consistently make shots which attain the desired trajectory and direction of travel of the ball. However, most other golfers continuously wrestle with the nagging problem of being unable to swing the golf club 32 in such a manner that the lofty goal of consistent and desired ball trajectory and direction is unattainable. While it is unlikely that most non-professional golfers will ever attain the inherent ability demonstrated by professional golfers, the non-professional golfers can improve their playability of the game of golf through the training of selected muscles used in the swinging of a golf club.

As a starting point, in order to attain the desired result, the golfer 30 must possess the ability to properly grip the club 32, and to maintain an appropriate stance and posture when swinging the club. Then, the golfer 30 must commit to exercising certain muscle groups, which are located in their hands, wrists, shoulders and other parts of the body, necessary to provide the consistent ability to produce good golf shots under any kind of pressure.

Various embodiments of muscle trainers described herein are designed to facilitate methods of exercising and training the appropriate muscles typically utilized by the golfer 30 in the swinging of the club 32. Such exercises are designed to enhance the strength and balance of these muscles, and to fine tune the muscle memory patterns necessary for consistent production of good golf shots. The methods of exercising accomplished by the use of the muscle trainers described herein can be appreciated by an understanding of the below-described principles of the relationships between the swinging of the golf club 32 and the muscles and muscle groups involved in such swinging action.

In a "two-plane-merger" golf swing theory, the two planes are referred to as the club shaft plane and the club face plane. With regard to the club shaft plane, it would be very difficult, if not impossible, for a human being to swing a golf club through a complete stroke while keeping the club shaft in one club shaft plane, in which said plane is a true plane. Hence, it is correct to state that the path in which the club shaft travels is not a true plane. The club shaft plane is a composite of an infinity of planes existing in a tangential relationship to the path of the club shaft.

The club face plane represents the position of the club face, in space, during the backswing. Regardless of the loft of the club face, the club face plane represents the position of the club face as if the club face had zero degrees of loft, and is more appropriately defined as a true plane since it is an extension of the surface of the club face. The concept of the club face plane helps one to visualize the relationship between the movement of the club face and the club shaft during the swinging motion of the club.

At the address, or six o'clock, position, the club face plane is ideally a vertical plane which is essentially perpendicular to the club shaft plane. During the backswing, the club face 52 and the club face plane are rotated, by the golfer, about the axis of the club shaft 34 to allow for a mechanically efficient movement in which the club face "slices" through the air in an aerodynamic fashion. Ideally, somewhere between the eight o'clock and ten o'clock backswing positions, the club face plane is rotated through approximately ninety degrees whereby the club face plane merges, and is co-planar, with the club shaft plane. This ideal ninety degree rotation is referred to as the "merged" position. During the backswing completion and the downswing, the club face should remain merged with the club shaft plane until just before impact when the club face plane rotates approximately ninety degrees into an impact position. This action defines the two-plane-merger golf-swing theory.

Errors within this two-plane-merger theory are referred to as "demerged" situations. These demerger errors occur when the amount of club face plane rotation is either greater or less than ninety degrees. When the angle of club face rotation is less than ninety degrees, the club face is said to be in a "closed" or "shut" position. When the angle of rotation is greater than ninety degrees, the club face is said to be in an "open" position.

Other crucial variables associated with the swing include speed and arc. The arc refers to the path of the club head 36 and is determined by the amount of extension of the hands away from the golfer's body, the timing of the golfer's wrist hinge, the amount of shoulder turn, and the amount of hip turn by the golfer. The arc and speed variables are much easier to manipulate and manage once the proper muscle memory for the two-plane merger has been achieved.

Figure 2:
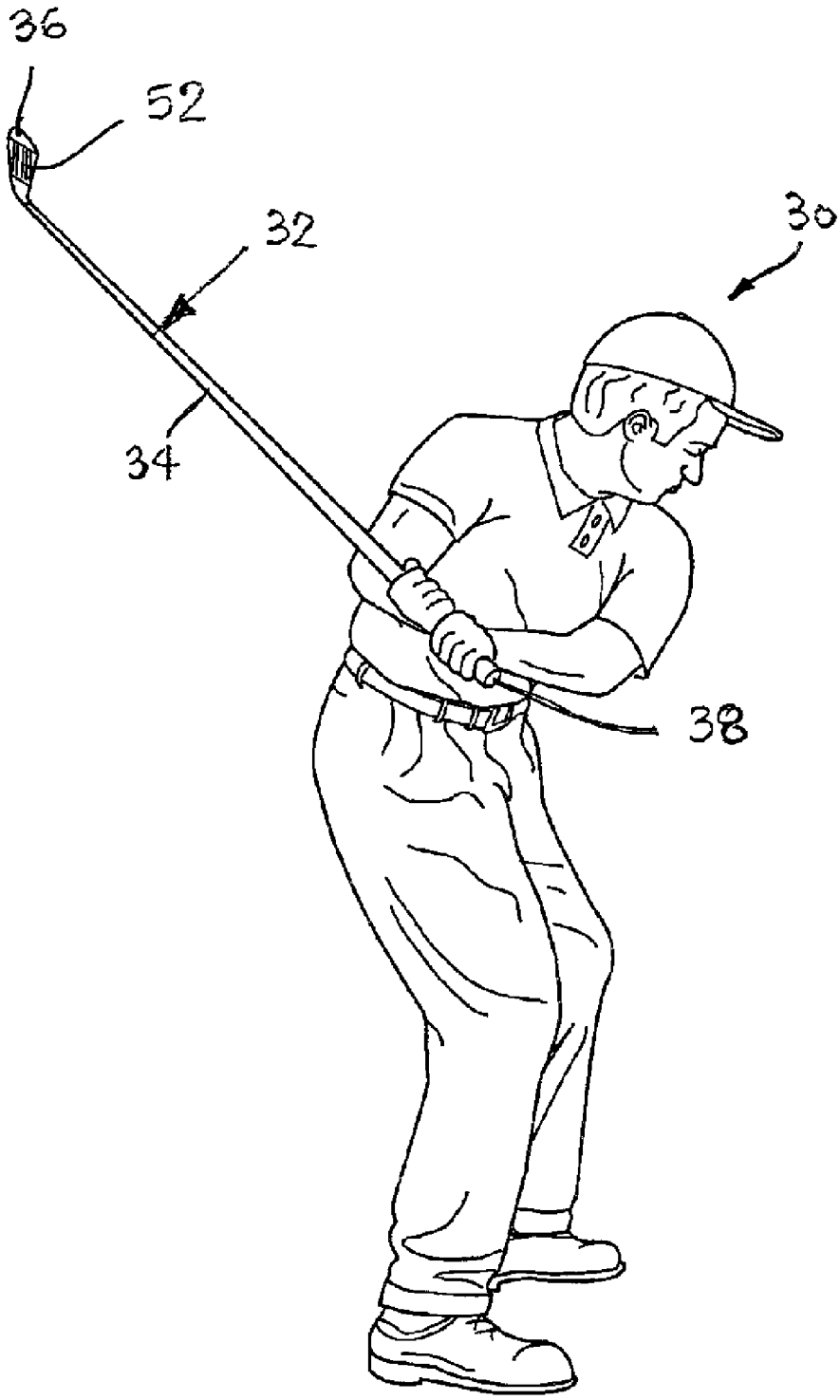
FIG. 2 is a perspective view showing the golfer of FIG. 1 with the club having nearly reached the backswing completion position, and being located undesirably behind the ideal club shaft plane of FIG. 1.
Figure 3:
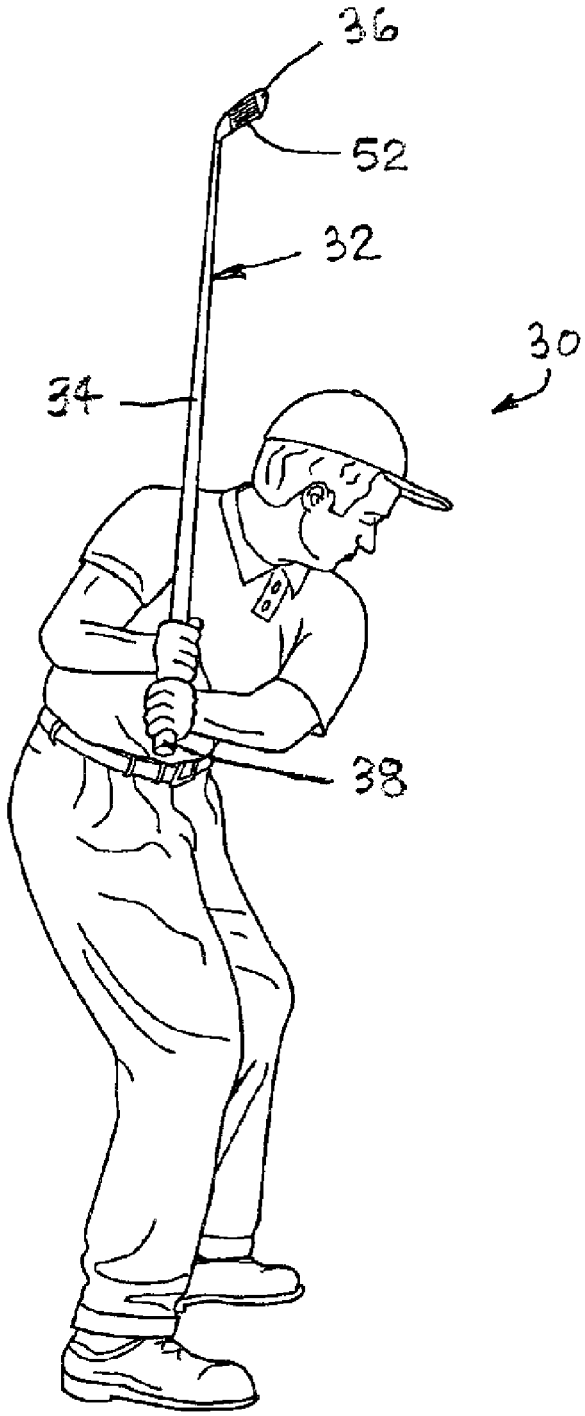
FIG. 3 is a perspective view showing the golfer of FIG. 1 with the club having nearly reached the backswing completion position and being located undesirably in front of the ideal club shaft plane of FIG. 1.

During the swinging motion, as viewed in FIG. 1, it is not uncommon for the non-professional golfer 30 to position the club shaft 32 outside of the ideal club shaft plane 42. Such deviation from the ideal club shaft plane will be referred to hereinafter as positioning the club shaft in front of or behind (i.e., above or below, respectively, as viewed in FIG. 1) the ideal club shaft plane. Referring to FIG. 2, the illustrated location of the club 32 indicates that the club shaft is in a position which is behind the ideal club shaft plane illustrated in FIG. 1. Referring to FIG. 3, the illustrated location of the club 32 indicates that the club shaft is in a position which is in front of the ideal club shaft plane illustrated in FIG. 1.

It is important for the golfer to minimize, and hopefully eliminate, the amount of club shaft deviation, which is in front of, or behind, the ideal club shaft plane. This requires a proper and balanced functioning of two groups of muscles in the golfer's hands and forearms. The group of muscles associated with positioning the club shaft in front of the ideal club shaft plane are referred to as the "front-of-the-plane muscles," and the group of muscles associated with positioning the club shaft behind the ideal club shaft plane will be referred to as the "behind-the-plane muscles." When these two muscle groups are in concert, that is of equal strength and balance, the golfer 30 is able to swing the golf club 32 with the club shaft 34 being within the ideal club shaft plane 42.

The direction of any deviation of the club shaft 34 during the backswing motion, that is, whether such direction is in front of, or behind, the ideal club shaft plane 42, can be determined by an observer of the golfer during the backswing motion and presented to the golfer for use in taking corrective action such as that described herein. Also, a video camera can be used to record the golfer's direction of deviation, and thereafter observed by the golfer 30 in a video playback for use in taking corrective action.

Figure 6:
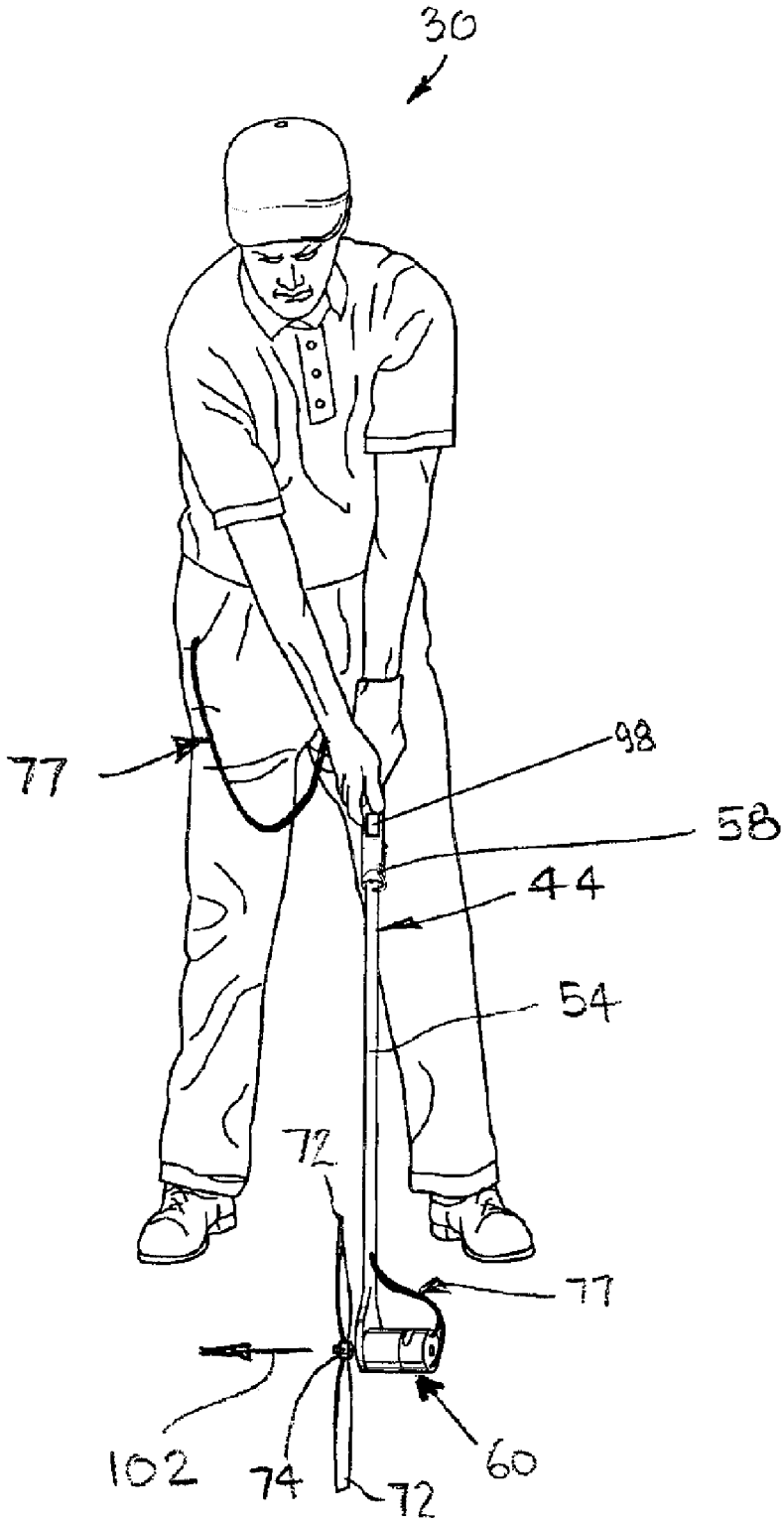
FIG. 6 is a front perspective view showing the golfer of FIG. 1 gripping the muscle trainer of FIG. 4, with the muscle trainer in a six o'clock position in preparation for a muscle training exercise, in accordance with a preferred embodiment of the invention.

When the golfer 30 is standing in the address position, as illustrated in FIG. 6, the hands, wrists, arms and shoulders of the golfer form a triangle. For a right-handed golfer, the front-of-the-plane muscles are located on the back of the left hand, the outside of the left forearm, the palm of the right hand and the inside of the right forearm, and include the right flexor carpi ulnaris, the right flexor profundis and superficialis, the left carpi radialis longus and brevis, and the left extensor carpi ulnaris. The behind-the-plane muscles are the mirror image of the front-of-the-plane muscles, i.e., substitute "left" for "right" and "right" for "left" in the foregoing named muscles. For a left-handed golfer, these relationships are exactly opposite.

During the backswing, the front-of-the-plane and the behind-the-plane muscle groups are, in essence, in a tug-of-war, with each muscle group being at respective opposite ends of an imaginary rope. If the behind-the-plane muscles are overacting, or dominating, the pulling force of these muscles moves the club shaft 34 behind the ideal club shaft plane 42. The opposite effect occurs if the front-of-the-plane muscles are overacting, or dominating. In such situations, a strengthening of the dominated muscle group is required in order to preclude either group from dominating the other group, thereby bringing balance to the tug-of-war and maintaining the club shaft 34 in the ideal club shaft plane 42.

The tug-of-war between these two muscle groups is further complicated by the need for an approximately ninety degree rotation of the shaft and club face to merge the club face plane with the club shaft plane under the two-plane-merger golf swing theory as described above. The merger of the two planes during the backswing occurs somewhere between an eight o'clock position and a ten o'clock position, and the two planes should remain merged until just before impact between the club face and the ball during the down swing. Obtaining and maintaining the merger of the club shaft plane and the club face plane until just before impact creates a mechanically efficient swing in which the club face cuts through space in an aerodynamic fashion, as noted above. Such merger is essential in developing a repeating swing pattern which is effective under pressure.

The rotation of the club shaft and the club face to effect the two-plane merger utilizes a rotary muscle system, which includes muscles from the front-of-the-plane muscle group and the behind-the-plane muscle group. When viewing a golfer's swing while standing in front of the golfer, the rotary muscle system can be divided into two muscle groups: the counter-clockwise rotary muscle group and the clockwise rotary muscle group. In particular, the counter-clockwise rotary muscles for a right-handed golfer include the right supinator, the right brachioradialis, the left pronator teres, and the left pronator quadratus. The clockwise rotary muscles for a right-handed golfer include the left supinator, the left brachioradialis, the right pronator teres, and the right pronator quadratus. These relationships are reversed for a left-handed golfer.

In the two-plane-merger theory, over action of either group of rotary muscles will result in demerged errors. For example, during the backswing of a right-handed golfer, over action of the clockwise rotary muscle group will result in closed club face position. Over action of the counter-clockwise rotary muscle group will result in an open club face position.

While practicing, a golfer may frequently use positioning drills to improve the positioning of the club during his swinging motion. These positioning drills are usually performed at a swing speed which is much slower than the swing speed the golfer uses in actual competition. Even with imbalanced muscle groups, reasonable attempts can be made to keep the club shaft within the ideal club shaft plane and to accomplish two-plane merger during periods when the club is being swung slowly. However, it becomes increasingly difficult to accomplish these goals when the speed of the swing is increased. To maintain the ideal club shaft plane and two-plane-merger when swinging at a speed the golfer uses during actual competition, there must be an exquisite balance between the front of the plane muscle group and the behind the plane muscle group as well as the counter-clockwise rotary muscle group and the clockwise rotary muscle group.

Thus, in order for any golfer suffering from the muscle domination deficiencies described above who wishes to improve their ability to play the game of golf, an exercise program to balance the four muscle groups is an absolute necessity. Given that a golfer wishes to embark on such an exercise program, the key is to be able to address the specific needs of the muscles of the four groups in such a way that the strength balance and consistent muscle memory patterns between the four muscle groups are attainable.

The various muscle trainers described herein are designed to exercise the muscles of the four muscle groups, while placing a greater effort in strengthening the dominated, or weaker, muscle groups. In this manner, the dominating group of muscles is exercised to retain the muscle tone thereof, while at the same time the dominated group of muscles is worked and exercised more vigorously to improve the muscle tone thereof, and to bring the four groups into a balanced condition. Further, by working and exercising the four muscle groups together, enhanced muscle memory patterns are developed there between.

Once the four muscle groups have attained parity in strength, balance, and memory patterns, the golfer 30 can maintain the club shaft 34 more consistently within the club shaft plane, and more effectively practice the principle of the two-plane-merger theory, to attain desired trajectory and direction of travel of the ball 40.

As shown in FIGS. 4 and 5, the muscle trainer 44 of a first embodiment of the invention includes a hollow shaft 54 having a flat motor-mount pad 56 formed at a distal end of the shaft, and a grip 58 attached to an outer side of the shaft adjacent a proximal end thereof. The grip 58 is formed from a soft non-metallic material, such as, for example, leather, of the type typically used to form the grip of a conventional golf club, such as, for example, the club 32 (FIG. 1).

Referring to FIGS. 4 and 5, the muscle trainer 44 further includes an electric motor 60 having a rotatable drive shaft 62 extending from one end of a motor housing 64 thereof. One end of the motor housing 64 is placed against a first side 66 of the pad 56, and is attached to the pad, such as by screws 67. The drive shaft 62 extends through an opening 69 formed through the pad 56 to a second side 68 of the pad.

The motor 60 could be of the type typically used to power radio-controlled miniature models such as, for example, model airplanes. The motor 60 could be of the type referred to as universal motors, which can operate either from a DC power source or an AC power source, and which are commonly used to operate small household appliances and light-duty power tools. The speed of operation of the motor 60 can be controlled and varied, for example, by use of a rheostat, a variable transformer with rectification, or electronically by use of a silicon controlled rectifier. Further, a reversing switch can be used with the motor 60 to facilitate selective operation of the motor in either rotational direction. Suitable examples of speed controls and a reversing switch are described in Chapter 3, and illustrated at FIGS. 3.1.1, 3.1.2, 3.1.3 and 3.3.10, of a handbook titled "DC MOTORS SPEED CONTROLS SERVO SYSTEMS," Fifth Edition, August, 1980, obtained from Electro-Craft Corporation of Hopkins, Minn., and locatable by Library of Congress Catalog Card Number 78-61244.

Referring to FIGS. 4 and 5, a fan blade assembly 70 includes a pair of blades 72, which are fixedly attached to a hub 74. The hub 74 is mounted to the distal end of the rotatable drive shaft 62 of the motor 60, and is attached to the drive shaft 62 for rotation therewith. A protective cage 76 is preferably fixedly attached to the pad 56 to preclude the blades 72 from coming into injurious or damaging contact with anyone, or any object, external to the cage. It is noted that each of the embodiments of the muscle trainer described herein preferably include a protective cage, such as the cage 76, which is not illustrated in all of the drawings thereof for the purpose of providing a clear illustration of the environment of a fan blade assembly of each respective embodiment.

In the motor-mounted arrangement illustrated in FIGS. 4 and 5, a common axis of the motor 60 and the blades 72 preferably extends at an angle of about ninety degrees from the shaft 54. The combination of motor 60 and the fan blade assembly 70 are one embodiment of a force generator.

Referring to FIG. 4, a wiring assembly 77 includes a pair of electrically conductive wires 78 and 80, which are connected at one end thereof to a plug 82, and at an opposite end thereof to the motor 60. The wires 78 and 80 extend from the plug 82, through an axial opening 84 formed in the proximal end of the hollow shaft 54, through an axial passage 86 within the hollow shaft, through an opening 88 formed through a side portion of the shaft near the pad 56, and to the connection with the motor 60.

A power source 90, such as an interchangeable and rechargeable electrical battery pack, is preferably connected through a pair of electrical wires 92 and 94 to a receptacle 96, which mates with and is connectable to the plug 82, to facilitate the application of electrical operating power from the battery pack to the motor 60. An ample length of the wiring assembly 77 preferably extends between the plug 82 and the shaft opening 84 to provide for selective placement of the battery pack 90 by the golfer 30 during use of the muscle trainer 44. As indicated above, the motor 60 could be operated by use of an AC power source, such as a single-phase 60-hertz source typically available through a conventional household power outlet or the like. Alternatively, power cells, such as batteries, can be disposed in the handle or shaft of the club.

A spring-biased push-button switch 98 is mounted on the grip 58, at any location which provides convenient access to the thumbs, fingers or hands of the golfer 30 to facilitate selective operational control of the muscle trainer 44 by the golfer during an exercise session. Preferably, the push-button switch 98 is located on the grip 58 so that the inboard thumb of the golfer 30 overlays the switch 98 when the golfer places the golfer's hands around the grip 58 in the conventional club-gripping manner. While the golfer's hands are in this position, the golfer can selectively operate the motor 60 by depressing the push-button switch 98 when the golfer is in an exercise mode without disturbing the position of either hand around the grip 58.

During the period when the golfer 30 is processing through an exercise cycle, the golfer maintains the push-button switch 98 in the closed state by continuing to depress the switch 98, so that the motor 60 remains operational during the exercise cycle. Upon release of the push-button switch 98, the spring-biased switch is opened to remove operating power from the motor 60. If desired, the push-button switch 98 could be mounted at different locations on the grip 58 to accommodate different gripping positions of respective users of the muscle trainer 44.

Referring to FIG. 4, a control module 100 is connected to the wiring assembly 77 and contains a speed controller and a reversing switch, for example, such as that described above, to allow the user of the muscle trainer 44 to pre-select the speed and direction of rotation of the motor 60 prior to using the muscle trainer during an exercise mode. The speed controller is a first enhancement of the basic invention embodied in the muscle trainer 44, the reversing switch is a second enhancement of the basic invention embodied in the muscle trainer 44, and the combination of the speed controller and the reversing switch is a third enhancement of the basic invention embodied in the muscle trainer 44. In alternative embodiments of the invention, the control module 100 is located in the handle or elsewhere in the shaft.

In the following example of use of the muscle trainer 44, and the practice of a method of exercising two sets of muscles, the golfer 30 is a right-handed golfer, and the front-of-the-plane muscles form the dominated muscle group.

When the golfer 30 anticipates using the muscle trainer 44 during an exercise session, the golfer will preferably use the conventional golf club 32 and process through several practice strokes in the presence of a personal observer, or in front of a video camera, in order to determine, as described above, whether the club shaft 34 is in front of the ideal club shaft plane 42 or behind the ideal club shaft plane. Assuming that information relayed by the observer, or through use of the video camera, indicates that the golfer's front-of-the-plane muscles are the dominated group of muscles, the golfer 30 will make the desired speed and direction-of-rotation adjustments, through the control module 100.

The speed of the motor 60 and the blades 72 will establish the magnitude of a pulling force at which the distal end of the muscle trainer 44 is urged, in the manner described below. The golfer 30 can adjust the speed controller of the control module 100 to selectively establish the linear pulling force level at which the golfer wishes to conduct the exercise cycle. Then, as described below, the adjustment of the reversing switch of the control module 100 will establish the direction in which the linear pulling force is to be applied.

After making the speed and direction-of-rotation adjustments at the control module 100, the golfer 30 then places the battery pack 90 of the muscle trainer 44 in a convenient location such as, for example, the right front pocket of the golfer's pants as illustrated in FIG. 6. It is noted that, instead of placement in the pants pocket, the battery pack 90 could be clipped to the golfer's belt, or placed at other locations, which will accommodate a comfortable and unimpeded swinging of the muscle trainer 44.

The golfer 30 grasps the grip 58 of the muscle trainer 44 in the conventional club-gripping manner, with the blades 72 extending to the right of the golfer, again as indicated in FIG. 6. The golfer 30 assumes a position and stance as if the golfer is addressing a ball at the six o'clock position as illustrated in FIG. 6. It is noted that the combined axial length of the grip 58, the shaft 54, the pad 56 and the blades 72 is slightly less than the length of a typical golf club, such that the blades are above a surface on which the golfer is standing during the exercise session.

The golfer 30 depresses the spring-biased push-button switch 98, such as by use of the golfer's inboard thumb, to operate the motor 60. With the appropriate direction of rotation of the motor 60 having been selected by prior adjustment of the reversing switch, the linear pulling force generated by the rotary movement of the blades 72 will urge the distal end of the muscle trainer 44 to the golfer's right, as indicated by an arrow 102 in FIGS. 6, 8 and 9. To initiate an exercise phase of the exercise cycle, the golfer 30 swings the muscle trainer 44 from the address position (FIG. 6) through a conventional non-stop backswing while processing through the positions shown in FIGS. 7, 8 and 9.

In the alternative, the golfer 30 could process the muscle trainer 44 through several step-and-stall motions, as described below, until reaching the fully completed backswing position illustrated in FIG. 9. During the step-and-stall motions, the golfer steps the trainer from the address position at six o'clock to a next position, such as, for example, the seven o'clock position, and stalls the motion of the trainer before advancing, for example, to the eight o'clock position. This pattern is continued through each clock position, for example, and so on to the fully completed backswing position illustrated in FIG. 9, while retaining the muscle trainer at each stepped position for a prescribed time before moving the trainer to the next stepped position.

During the non-stop backswing, or the step-and-stall motions, by the golfer 30, the dominating muscle group and the dominated muscle group, work together in the tug-of-war context in an attempt to maintain the shaft 54 of the muscle trainer 44 within the club shaft plane through the swinging stroke in the same manner that such muscle groups would move the golf club 32, when the golfer is swinging the club. In this manner, the dominating muscle group and the dominated muscle group are being worked together to the extent that both groups are being exercised and the muscle memory patterns of the two groups are being enhanced.

Additionally, as indicated by the arrow 102 in FIGS. 8 and 9, the motor 60 is rotating the blades 72 in such a direction that the linear pulling force generated by the rotating blades is urging, or attempting to pull, the muscle trainer 44 in the illustrated direction. This direction is opposite the direction that the dominated muscle group would normally be directing the trainer 44. Consequently, the dominated muscle group, which, in this instance, is the front-of-the-plane muscle group, is working more strenuously, than the dominating muscle group, i.e., the behind-the-plane muscle group, not only to attempt to locate the shaft 54 in the club shaft plane, but to also overcome the linear pulling force of the rotating blades 72. In this manner, the front-of-the-plane muscles, which comprise the dominated muscle group, are being stressed more than the behind-the-plane muscles, in an exercise context.

Upon reaching the full backswing position (FIG. 9), the golfer 30 releases the spring-biased push-button switch 98, and the motor 60 ceases to operate, thereby completing one cycle of the exercise motion, with the resulting effect of overtraining the front-of-the-plane muscles to thereby bring the tug-of-war between the two muscle groups into a balanced perspective leading to the sculpting of an ideal club shaft plane.

If the front-of-the-plane muscles of a right handed golfer are the dominating muscles, the muscle trainer 44 may be revolved through one hundred and eighty degrees so that the linear pulling force of the rotating blades 72 is in a direction which is opposite the direction of the arrows 102, shown in FIGS. 6, 7, 8 and 9. The muscle trainer 44 would then be processed through the same exercising steps described above, except that the behind-the-plane muscles, which in this instance are the dominated muscles, would be more strenuously exercised for the reasons expressed above.

In the alternative, the reversing switch of the control module 100 could be reversed from the state described above, where the front-of-the-plane muscles were the dominated muscles, so that the rotation of the motor 60, and the blades 72, would be reversed to provide a linear pulling force in a direction opposite the direction of the arrows 102 shown in FIGS. 6, 7, 8 and 9.

If the golfer 30 is left handed, the orientations of the linear pulling forces for the left handed golfer are mirror images of the above described pulling forces for the right handed golfer. Therefore, the reversing switch of the muscle trainer 44 would be switched accordingly to provide the mirror image pulling forces to accommodate the left handed golfer 30. Otherwise, the muscle trainer 44 would be used in the same manner as described above with respect to the right handed golfer.

As shown in FIG. 10, the muscle trainer 104, which is a second embodiment of the invention, includes a hollow shaft 106. The muscle trainer 104 differs from the muscle trainer 44 (FIG. 4) in that the length of the shaft 106 is shorter than the length of the shaft 54. Otherwise the muscle trainers 44 and 104 are substantially identical. Except for the shaft 106, the elements of the muscle trainer 104 are identified in FIG. 10 by the same numbers as the corresponding elements of the muscle trainer 44 shown in FIG. 4.

In the motor-mounted arrangement of the muscle trainer 104, as illustrated in FIG. 10, a common axis of the motor 60 and the blades 72 extends at an angle of ninety degrees from the shaft 54 in the same manner as in the motor-mounted arrangement of the muscle trainer 44.

The muscle trainer 104 is preferably used in the same manner as the muscle trainer 44, as described above. The shorter shaft 106 allows the muscle trainer 104 to be used in a closer-quarters environment, such as, for example, a room within a house. Otherwise, the advantages attainable by use of the muscle trainer 44, as described above, are also attainable by use of the muscle trainer 104.

As noted above, the rotation of the club shaft and the club face to effect the two-plane merger utilizes a rotary muscle system, which includes muscles from the front-of-the-plane muscle group and the behind-the-plane muscle group. The specific muscles included in the rotary muscle system for both left handed and right handed golfers are identified above. These rotary muscles should also be exercised and sculpted to provide total enhancement of the golfer's swing.

With that in mind, as shown in FIGS. 12 and 13, the muscle trainer 108 is a third embodiment of the invention. The muscle trainer 108 includes a hollow shaft 110 having a flat motor-mount pad 112 formed at a distal end of the shaft, and a grip 114 attached to an outer side of the shaft adjacent a proximal end thereof. The grip 114 is formed from a soft non-metallic material, such as, for example, leather, of the type typically used to form the grip of a conventional golf club, such as, for example, the club 32.

The shaft 110 is formed with a first straight section 116, which includes the grip 114, and a second straight section 118, which extends at an angle of substantially ninety degrees from the section 118 at a juncture 120 of the first and second straight sections. The shaft 110 is further formed with a third straight section 122, which extends at an angle of substantially ninety degrees from the second straight section 118 at a juncture 124 of the second and third straight sections. The first straight section 116 is also referred to herein as a grip section, the second straight section 118 is also referred to herein as an intermediate section, and the third straight section 122 is also referred to herein as a motor-mount section.

As shown in FIGS. 13 and 14, the first and second straight sections 116 and 118, respectively, of the shaft 110 are located in a plane, hereinafter referred to as "the common plane," while the third straight section 122 extends perpendicularly from the common plane.

Referring to FIGS. 12 and 13, the muscle trainer 108 further includes an electric motor 126 having a rotatable drive shaft 128 extending from one end of a motor housing 130 thereof. The one end of the motor housing 130 is placed against a first side 132 of the pad 112, and attached to the pad by screws 134. The drive shaft 128 extends through an opening 136 formed through the pad 112, and from a second side 138 of the pad.

A fan blade assembly 140 includes a pair of blades 142, which are fixedly attached to a hub 144. The hub 144 is mounted on the free end of the rotatable drive shaft 128 of the motor 126, and is attached to the drive shaft for rotation therewith. In this arrangement, the combination of the motor 126 and the fan blade assembly 140 form a force generator.

A protective cage of the type shown in FIG. 4 may be fixedly attached to the pad 112 to preclude the blades 142 from coming into injurious or damaging contact with anyone, or any object, external to the cage. The muscle trainer 108 also preferably includes the wiring assembly 77, the battery pack 90, the push-button switch 98, and the control module 100 with the speed controller and the reversing switch in the same fashion as the muscle trainer 44.

In the motor-mounted arrangement of the muscle trainer 108, as illustrated in FIGS. 12 and 13, a common axis of the motor 126 and the blades 142 extends at an angle of ninety degrees from the common plane in which the first and second sections 116 and 118, respectively, are located. This is preferably the same angular relation in which the common axis of the motor 60 and the blades 72 of the muscle trainer 44 is mounted with respect to the shaft 54 thereof. With this angular relationship, the muscle trainer 108 will provide a linear pulling force, in the direction of the arrow 102 (FIGS. 6 and 14), comparable to the linear pulling force provided by the muscle trainers 44 and 104. Therefore, this linear-pulling-force feature of the muscle trainer 108 provides the opportunity for the golfer 30 to use the muscle trainer 108 to exercise the front-of-the-plane muscles and the behind-the-plane muscles in the same manner described above with respect to the muscle trainers 44 and 104.

In addition, with the second straight section 118 of the shaft 110 of the muscle trainer 108 being offset by ninety degrees from the first straight section 116, or grip section, significant rotational forces are generated as the blades 142 are rotated by the motor 126. The rotational forces generated by the rotating blades 142 are represented in FIG. 14 by a rotating-arrows symbol 146.

Referring to FIGS. 14, 15 and 16, when using the muscle trainer 108, the golfer 30 grasps the grip 114 in the conventional golf-gripping manner, depresses the push-button switch 98 and proceeds with a non-stop backswing, or the step-and-stall motions, to process through an exercise cycle in the same manner as described above with respect to the use of the muscle trainer 44. During the exercise cycle, the front-of-the-plane muscles and the behind-the-plane muscles are exercised in the manner described above. Also, the rotary muscles are being stressed by the rotational forces generated by the effect of the rotating blades 142 being offset from the axis of the first straight section 116, and are exercised by the golfer's reactionary efforts in response to the rotational forces.

For a right-handed golfer with over action of clockwise rotary muscle group during the backswing, the club face would be in a closed position at the backswing completion position. To achieve two-plane-merger in this situation, the dominated counter-clockwise rotary muscle group must be exercised in a more strenuous fashion than the dominating clockwise rotary muscle group. This would require that the propeller generate a clockwise rotary force on the implement. Likewise, if there is over action of the counter-clockwise rotary muscle group, the propeller would be set to generate a counter-clockwise rotary force on the implement.

With dedicated exercising use of the muscle trainer 108 over an extended period, the golfer 30 will obtain a proper club shaft plane and rotary muscle memory to the extent that the action of the hands, wrists and arms can be thought of as being on automatic pilot. This allows the golfer 30 to easily concentrate on other essentials such as swing speed, swing arc, keeping the golfer's weight from shifting to the outside of the golfer's right foot, if the golfer is right handed, or outside the golfer's left foot, if the golfer is left handed, and driving the downswing with the larger muscles of the torso.

As shown in FIG. 13, the motor 126 and the blades 142 are located fully to one side of the common plane in which the first straight section 116, about which the grip 114 is located, and the second straight section 118 are located. With this arrangement, the axis of the motor 126 and the blades 142 extends perpendicularly from the common plane.

Other arrangements could be employed where the motor and the blades do not extend fully to one side of the common plane, but the axis of the motor and the blades continues to be perpendicular to the common plane. For example, with reference to FIG. 13, the pad 112 could be formed at a distal end of the straight section 118, in place of the illustrated junction 124, to form a distal end of the shaft 110. In this arrangement, the pad 112 would be in the common plane. The motor 126 would be mounted on one side of the pad 112, and thereby on one side of the common plane, and the blades 142 would be located on the other side of the pad, and thereby on the other side of the common plane, with the axis of the motor and the blades being perpendicular to the common plane. This assembly of the pad 112, the motor 126 and the blades 142 would then resemble the assembly of the pad 56, the motor 60 and the blades 72, respectively, at the distal end of shaft 54, as shown in FIG. 4.

Other arrangements, in which the force generator is perpendicular to the common plane, are illustrated in FIGS. 11, 19 and 20. As shown in FIG. 11, a jet engine 148, of the type typically used with model airplanes, is mounted on the pad 112, where the pad is located at the distal end of the straight section 118 of the muscle trainer 108 as modified in the manner described above. In this arrangement, the jet engine 148 forms a force generator.

As shown in solid view in FIG. 19, the muscle trainer 108 has been modified to replace the straight section 122 (FIG. 13) with a shorter straight section **122*a* of the shaft 110, which is also located in the common plane, whereby the motor 126 straddles, and the common axis of the motor and the blades 142** are perpendicular to, the common plane.

Referring to FIG. 20, the muscle trainer 108 has been modified to replace the motor 126 and the fan blade assembly 140 with an integral assembly 150. The integral assembly 150 includes a shroud 152 having an enclosed side wall with axial openings at opposite ends thereof. A motor 154 is mounted partially within, and extends from a first of the axial openings of, the shroud 152. A fan blade assembly 156 is mounted on a shaft of the motor 154 and is contained within the shroud 152 adjacent a second of the axial openings thereof. The combination of the motor 154 and the fan blade assembly 156 form a force generator.

In preparation for assembly with the integral assembly 150, the muscle trainer 108 is modified to the extent that the distal end of the straight section 118 is the distal end of the now padless shaft 110. As shown in FIG. 20, the distal end of the modified straight shaft 118 is connected directly to an outer surface of the shroud 152. Since the straight section 118 is in the common plane, the integral assembly 150 straddles, and the common axis of the motor 154 and the fan blade assembly 156 is perpendicular to, the common plane.

While the muscle trainer 108 provides for the mounting of the straight section 116 of the shaft 110 at an angle of ninety degrees with respect to the straight section 118, the golfer 30 may find more comfort and greater ease of exercising with an angle greater or less than ninety degrees between the sections 116 and 118. With that in mind, the muscle trainer 108, as shown in FIG. 13, is modified by placing a first adjustment mechanism 158, shown in FIG. 17, at the juncture 120 of the shaft 110.

In particular, the straight section 116 is separated from the straight section 118 at the juncture thereof to form adjacent free ends of the straight sections. The adjustment mechanism 158 includes a first connection member 160, which is attached to the free end of the straight section 116, and is formed with a flat portion having a hole 162 formed there through. The adjustment mechanism 158 further includes a second connection member 164 which is attached to the free end of the straight section 118, and is formed with a flat portion having a hole 166 formed there through. The flat portions are placed in overlapping assembly with the holes 162 and 166 being in alignment. A threaded portion 168 of a bolt 170 is located through the aligned holes 162 and 166, while a head 172 prevents the bolt from being moved through the holes. A threaded fastener 174 is placed on the threaded portion 168 of the bolt 170 and tightened to retain the connection members 160 and 164 in assembly, and to connect and retain together the straight sections 116 and 118 of the shaft 110.

The fastener 174 can be loosened and the straight sections 116 and 118 manipulated to a perpendicular position or a non-perpendicular position selected by the golfer 30 relative to each other, and then retightened to secure the straight sections in the selected angular relationship. Since the straight sections 116 and 118 are located in the common plane, by using the muscle trainer 108, modified by the adjusting mechanism 158, the golfer 30 has the opportunity of selectively and adjustably locating the motor 126 and the fan blade assembly 140 in many different angular positions, perpendicular and non-perpendicular, with respect to the distal end of the straight section 116, while maintaining the common axis of the motor 126 and the fan blade assembly 140 perpendicular to the common plane.

The muscle trainer 108, as shown in FIGS. 12 and 13, can also be modified to accomplish the above-noted adjustability by replacing an intermediate portion of the straight section 118 of the shaft 110 with a second adjusting mechanism 176, which is shown in FIG. 18. With this arrangement, a proximal portion of the straight section 118 remains adjacent the junction 120, and a distal portion of the straight section 118 remains adjacent the junction 124.

The adjusting mechanism 176 includes two half shells 178 and 180, which, when assembled together, generally assume a "peanut" shape with opposite open ends. Each of the half shells 178 and 180 is formed with a concave interior, which interfaces with the concave interior of the other shell when the shells are assembled together. Two spherical elements 182 and 184 are spatially located within, and at opposite ends of, the interior of the assembled half shells 178 and 180, and extend partially from a respective one of the open ends.

An adjusting knob 186 is located along an outer side of the half shell 178 and cooperates with a threaded member extending from the half shell 180 and through the assembled half shells. Selective manipulation of the knob 186 allows a slight separation, without disassembly, of the half shells 178 and 180 so that the spherical elements 182 and 184 can be adjustably manipulated while being retained within the assembled half shells. The knob 186 can then be adjusted to move the half shells 178 and 180 to a tightened position, whereby the spherical elements 182 and 184 are clamped between the half shells in their manipulated positions.

The second adjusting mechanism 176 is illustrated, described and referred to as "a split arm assembly" in U.S. Pat. No. 5,845,885, which issued on Dec. 8, 1998, to Jeffrey D. Carnevali. A split arm assembly, of the type described herein as the second adjusting mechanism 176, is available commercially from National Products Inc. of Seattle, Wash.

Referring again to FIG. 18, the remaining proximal portion of the straight section 118, which is joined with the juncture 120, is attached to the spherical element 182. Also, the remaining distal portion of the straight section 118, which is joined with the juncture 124, is attached to the spherical element 184.

If the golfer 30 wishes to adjust the angular relationship between the straight section 116 of the shaft 110 and the straight section 118 thereof, the knob 186 is manipulated to relax the retention of the two half shells 178 and 180. Thereafter, the spherical element 182 is manipulated to make the desired angular adjustment, and the knob 186 is again manipulated to draw the half shells 178 and 180 tightly together to retain the selected angular adjustment.

During the adjustment process, the spherical element 184 is not manipulated, whereby the common axis of the motor 126 and the fan blade assembly 140 is retained in the perpendicular relation with the common plane. This perpendicular relationship can be permanently maintained by securing the distal portion of the straight section 118 within the space occupied by the spherical element 184 between the half shells 178 and 180.

It is noted that the distal portion of the straight section 118 of the shaft 110 can be adjusted if desired. Such adjustment would shift the common axis of the motor 126 and the fan blade assembly 140 into a non-perpendicular alignment with the common plane. Also, an adjustment mechanism, such as the adjustment mechanism 158 of FIG. 17, could be located in place of the juncture 124 of the shaft 110 to provide adjustment of the common axis of the motor 126 and the fan blade assembly 140 into a non-perpendicular alignment with the common plane.

When the common axis of the motor 126 and the fan blade assembly 140 is located at a non-perpendicular angle with respect to the common plane, a vector component of the non-perpendicular angle will be perpendicular to the common plane. This vector component is referred to hereinafter as "the perpendicular vector component." The perpendicular vector component will result in a force generation component directed in the manner comparable to direction of the force generation described above with respect to the non-adjustable muscle trainer 108 as shown in FIGS. 12 and 13. Thus, the golfer 30 will be able to maintain an exercise regimen comparable to that described above with respect to the non-adjustable muscle trainer 108.

In addition, other vector components of force generation are present when the common axis of the motor 126 and the fan blade assembly 140 are non-perpendicular with respect to the common plane. These vector components are referred to hereinafter as "the non-perpendicular vector components." The non-perpendicular vector components will result in force generation components which allow the golfer 30 to laterally extend the benefits of exercising of the front-of-the-plane muscles, the behind-the-plane muscles and the rotary muscles, thereby further enhancing the sculpting of these muscles.

As depicted in FIG. 21, an alternative embodiment of the invention includes a conventional golf club, such as a driver 188, that has been modified to provide facility for muscle training in a manner similar to the muscle trainers 44, 104 and 108, and the various above-described modified versions thereof. In particular, the driver 188 includes a hollow shaft 190, a club head 191 at a distal end thereof, and a grip 192 at a proximal end thereof, all in a conventional manner. A pair of support rings 194 are secured to selected spaced portions of the shaft 190, with each ring including a threaded stud 196 extending away from the shaft. The proximal end of the shaft 190 is formed with an opening (not shown) to facilitate insertion of a distal portion of a main wiring assembly 198 into an axial opening of the hollow shaft, with the main wiring assembly being connectible to a power source, such as the battery pack 90 described above. A push-button switch 199 is attached to the grip 192 and is connected to the main wiring assembly 198 in the manner described above with respect to the push-button switch 98.

Preferably, a pair of small openings are formed through intermediate portions of the shaft 190, with each opening being located adjacent a respective one of the pair of rings 194. Each of a pair of short wiring assemblies 200 are connected at an internal end thereof, internally of the shaft, to the main wiring assembly 198, and extend outward through a respective one of the small openings. External ends of the short wiring assemblies 200 are connected to respective ones of a pair of connectors 202.

As shown in FIG. 21, a motor and fan blade assembly 204 is in assembly with the modified driver 188. The motor and fan blade assembly 204, which is essentially the same as the assembly of the motor 126 and the fan blade assembly 140 as shown in solid in FIG. 19, includes the shaft section 118, a distal portion of which is shown in FIG. 19 in solid and a proximal portion of which is shown in dashed line.

As further shown in dashed line in FIG. 19, the motor and fan blade assembly 204 includes a connection member 206 formed with a band 208, which is attached to a proximal end of the shaft section 118. An arm 210 extends integrally from the band 208, and a coupling pad 212 is formed integrally with the arm. The coupling pad 212 is formed with a hole 214 there through which is positionable selectively over either of the pair of threaded studs 196, as shown in FIG. 21, which extend from the pair of rings 194 mounted spatially on the shaft 190 of the driver 188. As shown in FIG. 21, a short wiring assembly 216 is connected at one thereof to the motor 126, and at an opposite end thereof to a connector 218, which is designed to be connectible to either of the pair of connectors 202.

When the golfer 30 desires to use the modified driver 188 in a muscle training mode, the golfer places the hole 214 of the coupling pad 212 over the selected threaded stud 196 of the respective ring 194, which is attached to the shaft 190 of the driver. A threaded fastener is then placed on the stud 196 and tightened against the coupling pad 212 to secure the motor and fan blade assembly 204 with the modified driver 188. The main wiring assembly 198 is connected to the battery pack.

The golfer 30 then uses the modified driver 188 in the manner described above with respect to the use of the muscle trainer 108 to exercise the front-of-the-plane muscles and the behind-the-plane muscles, and the rotary muscles, in accordance with the principles of the invention described hereinabove.

While various force generators (i.e., the motors 60, 126 and 154, and their respective blade assemblies, and the jet engine 148) have been described above for use with respective ones of the various muscle trainers 44, 104 and 108, it is to be understood that any of the above-described force generators could be used with any of the various muscle trainers without departing from the spirit and scope of the invention.

In summary, with dedicated exercising use by a golfer of any of the above-described muscle trainers 44, 104, 108, or 188 over an extended period, the golfer will attain balanced muscle tone and memory between the front-of-the-plane muscles and the behind-the-plane muscles leading to a proper club shaft plane. Further, with dedicated exercising use of the muscle trainer 108 over an extended period, the golfer will also attain enhanced rotary muscle memory. With the attainment of these attributes, the action of the hands, wrists and arms in subsequent golf swings by the golfer, during the playing of the game of golf, can be thought of as being on automatic pilot. This allows the golfer to easily concentrate on other essentials such as swing speed, swing arc, keeping the golfer's weight from shifting to the outside of the right foot, if the golfer is right handed, or outside the left foot, if the golfer is left handed, and driving the downswing with the larger muscles of the torso.

The game of golf, and particularly the backswing of a golf club in playing the game of golf, has been used above as a centerpiece to describe the principles of the invention covered herein, as practiced by the use of the various embodiments and versions of the above-described muscle trainers, and the methods of exercising. However, the muscle trainers, and the methods of exercising, described above can also be used to enhance the muscle memory associated with other sports games and activities. For example, games such as baseball, softball, tennis, racket ball, weight lifting and weight throwing involve action between competing muscles to obtain balance and direction in the particular sports endeavor. Indeed, the muscle trainers, and the methods of exercising, described above can be used in many walks of life unrelated to sports games. For example, the swinging and directing of a maul into engagement with a target object requires separate muscle groups.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A method of exercising a weaker of two muscles used by a person when moving an implement, wherein, if the two muscles were of appropriate strength, the two muscles would desirably apply opposing forces in substantially opposite directions to the implement to maintain the implement in an ideal motion path, the method performed using a muscle trainer comprising a body and a grip disposed on the body, the method comprising:

(a) the person moving a device having characteristics of the implement in an actual motion path;

(b) determining an orientation of the actual motion path of step (a) relative to the ideal motion path;

(c) the person grasping the grip of the muscle trainer with at least one of the person's hands;

(d) when it is determined in step (b) that the actual motion path of step (a) deviates from the ideal motion path, applying a force to the muscle trainer body to urge the muscle trainer body further in the direction of deviation from the ideal motion path, where the applied force is independent of any force generated due to movement of the muscle trainer by the person; and (e) the person moving the muscle trainer in an actual motion path while steps (c) and (d) are performed.

2. The method of claim 1 wherein the person is a golfer and the method is for exercising the weaker of two muscles used by the golfer when swinging a golf club, wherein, if the two muscles were of appropriate strength, the two muscles would desirably apply opposing forces in substantially opposite directions to the golf club to maintain the golf club in the ideal motion path, wherein:

step (a) further comprises the golfer swinging the device having characteristics of a golf club in an actual motion path;

step (b) further comprises determining the orientation of the actual motion path of the device relative to the ideal motion path; and step (d) further comprises applying the force to the muscle trainer to urge the muscle trainer further in the direction of deviation from the ideal motion path when the determination is made in step (b) that the actual motion path of step (a) deviates from the ideal motion path.

3. The method of claim 2 wherein the body of the muscle trainer includes a proximal end near the grip and a distal end opposite the proximal end, and wherein:

step (c) further comprises the person grasping the grip of the muscle trainer with both hands, wherein the thumb of the person's non-dominate hand is closer to the proximal end of the muscle trainer than is the thumb of the person's dominate hand; and step (d) further comprises applying the force to the distal end of the muscle trainer to urge the distal end further in the direction of deviation from the ideal motion path when the determination is made in step (b) that the actual motion path of step (a) deviates from the ideal motion path.

4. The method of claim 1 further comprising:

(f) while performing step (e), pausing before completion of the movement in the actual motion path and holding the muscle trainer in a fixed intermediate position for a period of time;

(g) resuming the movement in the actual motion path at the end of the period of time; and (h) repeating steps (f) and (g) until completion of the movement in the actual motion path.

5. The method of claim 1 wherein step (b) further comprises recording video images of the person performing step (a) and observing the recorded video images.

6. The method of claim 1 wherein step (a) further comprises swinging a device having characteristics of an implement selected from the group consisting of a golf club, a baseball bat, a softball bat, a tennis racket, a racket ball racket, a weight lifting device, a weight throwing device, a maul, an axe and a hammer.

7. The method of claim 1 wherein the muscle trainer further comprises an electric motor and a propeller disposed on the muscle trainer, the propeller having a shaft oriented substantially in parallel with the motion path, and wherein steps (d) and (e) further comprise activating the motor to cause the propeller to spin, thereby creating the force on the muscle trainer body.

8. The method of claim 7 wherein the muscle trainer further comprises a switch disposed adjacent the grip, and wherein steps (d) and (e) further comprise setting the switch to activate the motor to cause the propeller to spin.

9. The method of claim 1 wherein the muscle trainer further comprises a force generator disposed on the muscle trainer body and wherein step (d) further comprises applying the force to the muscle trainer body by discharging a pressurized media from the force generator.

10. The method of claim 1 wherein the person is a golfer and the method is for exercising a weaker of two muscles used by the golfer when swinging a golf club, wherein, if the two muscles were of appropriate strength, the two muscles would desirably apply opposing forces in substantially opposite directions to the golf club to maintain the golf club in an ideal club shaft plane, wherein:

step (a) further comprises the golfer swinging the device having characteristics of a golf club in an actual club shaft plane;

step (b) further comprises determining an orientation of the actual club shaft plane of the device relative to the ideal club shaft plane; and step (d) further comprises step (d1) applying the force to the muscle trainer to urge the muscle trainer further in a direction behind the ideal club shaft plane when the determination is made in step (b) that the actual club shaft plane of step (a) is located behind the ideal club shaft plane, and step (d2) applying the force to the muscle trainer to urge the muscle trainer further in a direction in front of the ideal club shaft plane when the determination is made in step (b) that the actual club shaft plane of step (a) is located in front of the ideal club shaft plane; and step (e) further comprises the golfer swinging the muscle trainer in an actual motion path while step (c) and one of steps (d1) and (d2) are performed.

11. A method of exercising a weaker of two rotational muscles used by a golfer when swinging a golf club, wherein, if the two rotational muscles were of appropriate strength, the two muscles would desirably apply opposing rotational forces in substantially opposite rotational directions to the golf club to maintain an ideal orientation between a club face plane and a club shaft plane during the swing of the golf club, the method performed using a muscle trainer comprising a shaft, a grip disposed about the shaft, a longitudinal axis running through the shaft and a force generator attached to the shaft, the method comprising:

(a) the golfer swinging a device having characteristics of a golf club in an actual motion path;

(b) determining the orientation of the club face plane relative to the club shaft plane at one or more predetermined intervals in the actual motion path;

(c) the golfer grasping the grip of the muscle trainer with at least one of the golfer's hands;

(d) when it is determined in step (b) that the club face plane is over-rotated relative to the club shaft plane, applying a rotational force about the longitudinal axis of the shaft to urge the club face plane toward further over-rotation relative to the club shaft plane, where the rotational force urges twisting of the grip in the at least one hand of the golfer and is independent of any force generated due to movement of the muscle trainer by the golfer;

(e) when it is determined in step (b) that the club face plane is under-rotated relative to the club shaft plane, applying a rotational force to the longitudinal axis of the shaft to urge the club face plane toward further under-rotation relative to the club shaft plane, where the rotational force urges twisting of the grip in the at least one hand of the golfer and is independent of any force generated due to movement of the muscle trainer by the golfer; and (f) the golfer swinging the muscle trainer in an actual motion path while step (c) and one of steps (d) and (e) are performed.

12. The method of claim 11 wherein the force generator comprises an electric motor and a propeller, the propeller having a propeller shaft oriented substantially perpendicular to and offset from the longitudinal axis of the muscle trainer shaft, and wherein steps (d) and (e) further comprise activating the motor to cause the propeller to spin, thereby creating the rotational force about the longitudinal axis of the muscle trainer shaft.

13. The method of claim 12 wherein the muscle trainer further comprises a switch disposed adjacent the grip, and wherein steps (d) and (e) further comprise setting the switch to activate the motor to cause the propeller to spin.

14. The method of claim 11 wherein steps (d) and (e) further comprise applying the rotational force by discharging a pressurized media from the force generator.

15. The method of claim 11 wherein the shaft of the muscle trainer includes a proximal end near the grip and a distal end opposite the proximal end, and wherein:

step (c) further comprises the golfer grasping the grip of the muscle trainer with both hands, wherein the thumb of the golfer's non-dominate hand is closer to the proximal end of the muscle trainer than is the thumb of the golfer's dominate hand; and steps (d) and (e) further comprise applying the rotational force to the distal end of the muscle trainer shaft.

* * * * *